US008152410B2

(12) United States Patent
Roth

(10) Patent No.: US 8,152,410 B2
(45) Date of Patent: Apr. 10, 2012

(54) METHOD AND APPARATUS FOR COMPACTION, BREAKING AND RUBBLIZATION

(76) Inventor: Scott R. Roth, Plattsmouth, NE (US)

( * ) Notice: Subject to any disclaimer, the term of this patent is extended or adjusted under 35 U.S.C. 154(b) by 304 days.

(21) Appl. No.: 12/631,178

(22) Filed: Dec. 4, 2009

(65) Prior Publication Data

US 2010/0135724 A1 Jun. 3, 2010

Related U.S. Application Data

(63) Continuation-in-part of application No. 12/221,108, filed on Jul. 31, 2008, now Pat. No. 7,648,309, which is a continuation of application No. 11/796,174, filed on Apr. 27, 2007, now Pat. No. 7,410,323.

(51) Int. Cl.
*E01C 19/26* (2006.01)

(52) U.S. Cl. ..... 404/124; 172/604

(58) Field of Classification Search ..... 404/122, 404/124, 125, 128, 132, 133.05, 133.2; 172/452, 172/604

See application file for complete search history.

(56) References Cited

U.S. PATENT DOCUMENTS

| | | | | |
|---|---|---|---|---|
| 348,284 | A | 8/1886 | Horton | |
| 734,900 | A | 7/1903 | Lean | |
| 1,190,132 | A | 7/1916 | Dunham | |
| 1,831,116 | A | 11/1931 | Huntley | |
| 2,318,002 | A | 5/1943 | MacGregor | |
| 2,909,106 | A | 10/1959 | Berrange | |
| 3,192,838 | A | 7/1965 | Cook | |
| 3,662,658 | A | 5/1972 | Berrange | |
| 3,950,110 | A | 4/1976 | Clifford | |
| 3,966,346 | A | 6/1976 | Berrange | |
| 4,019,825 | A | 4/1977 | Berrange | |
| 4,147,448 | A | 4/1979 | Jeffrey | |
| 4,289,422 | A | 9/1981 | DeKlerk et al. | |
| 4,795,051 | A | 1/1989 | Ou | |
| 5,462,387 | A | 10/1995 | Roth | |
| 5,533,283 | A | 7/1996 | Roth | |
| 5,562,365 | A | 10/1996 | Berrange | |
| 6,485,227 | B1 | 11/2002 | Mathiowetz | |
| 6,554,532 | B1 * | 4/2003 | Motz et al. | 404/117 |
| 6,719,485 | B1 | 4/2004 | Roth | |
| 7,410,323 | B1 | 8/2008 | Roth | |
| 7,614,821 | B2 * | 11/2009 | Stromsoe | 404/85 |
| 7,648,309 | B2 * | 1/2010 | Roth | 404/124 |

* cited by examiner

*Primary Examiner* — Gary S Hartmann
(74) *Attorney, Agent, or Firm* — Suiter Swantz pc llo

(57) ABSTRACT

An apparatus for compaction, breaking and rubbilization comprises a first non-circular plate having a first plate flat portion and a first plate thickness, a second non-circular plate having a second plate flat portion and a second plate thickness substantially equivalent to the first plate thickness, and a third plate having a third plate first flat portion and a third plate second flat portion and a third plate thickness less than the first plate thickness and the second plate thickness. The first plate flat portion is coupled to the third plate first flat portion and the second plate is coupled to the third plate second flat portion and each of the first plate, the second plate and the third plate are configured to form a multi-lobed roller assembly.

14 Claims, 23 Drawing Sheets

METHOD AND APPARATUS FOR COMPACTION, BREAKING AND RUBBLIZATION

CROSS REFERENCE TO RELATED APPLICATIONS

The present application is a continuation in part of and claims the benefit under 35 U.S.C. §120 of U.S. patent application Ser. No. 12/221,108, filed Jul. 31, 2008, which in turn claims the priority to U.S. patent application Ser. No. 11/796,174 filed Apr. 27, 2007, currently U.S. Pat. No. 7,410,323, which are herein incorporated by reference in their entirety.

FIELD OF THE INVENTION

The present invention relates generally to construction machinery, and more particularly to an improved method and apparatus for providing material compaction, breaking and rubblization.

BACKGROUND OF THE INVENTION

Surface compaction, material breaking and rubblization are processes utilized in countless industries. For instance, in the repair and reconstruction of streets and highways, it is typically necessary to remove the existing concrete and materials and prepare the underlying surface for new concrete. Additional uses of such processes include soil and foundation compaction, cracking and seating of concrete, landfill compaction, runway formation and ground preparation therefor, as well as many others. Many of the current processes utilized for these applications are extremely time and labor intensive, and, for some applications, relatively ineffective.

Prior art apparatuses for soil compaction and concrete breaking include large, high-density balls, vibratory impact rollers, and guillotine-type breaking devices. Other methods available for breaking concrete include the use of jack hammers and the like. Again, such apparatus and methods are typically very slow.

In response to these problems, the inventor herein created several new devices, which are the subject of U.S. Pat. No. 5,462,387, entitled "Concrete Breaking Apparatus," U.S. Pat. No. 5,533,283, entitled "Compaction Roller Assembly and Grader," and U.S. Pat. No. 6,719,485, entitled "Compaction Roller and Method for Rubblizing Concrete." These inventions are very successful in compacting soil, and cracking and breaking the concrete of streets and roadways to permit removal of the surface material. However, the inventor has found the need for further additional devices and methods for surface compaction and material breaking and rubblizing.

Consequently, a method and apparatus for compaction, breaking and rubbilization of several materials in a variety of settings is needed.

SUMMARY OF THE INVENTION

It is therefore a general object of the present invention to provide an apparatus and method for material compaction, breaking and rubblization. According to a first aspect of the invention, an apparatus suitable for providing compaction, breaking and rubblization is disclosed. Apparatus may comprise a roller assembly and a frame assembly. Roller assembly may comprise a first non-circular plate having a first plate flat portion and a first plate thickness. Roller assembly may further comprise a second non-circular plate having a second plate flat portion and a second plate thickness. The thickness of the second plate may be substantially equivalent to the first plate thickness. Roller assembly may also comprise a third plate having a third plate first flat portion and a third plate second flat portion. Third plate may further comprise a third plate thickness. Third plate thickness may be less than each of the first plate thickness and the second plate thickness. The first plate flat portion may be coupled to the third plate first flat portion and the second plate flat portion may be coupled to the third plate second flat portion to form a non-circular plate weldment assembly in the shape of a non-circular multi-lobed roller. Roller assembly may comprise an axle assembly and may be mountable onto the frame assembly via the axle assembly.

Non-circular multi-lobed roller assembly coupled with an axle assembly and mounted onto a frame assembly is suitable for pushing or towing by a motorized or non-motorized towing or pushing apparatus. Each lobe of the roller assembly may further comprise a set first raised impact surfaces and a set of second raised impact surfaces. First raised impact surfaces form a non-continuous raised impact region across a width of a roller assembly lobe, spaced a distance apart from one another across the width of the roller assembly and projecting outwardly from the impact surface of each lobe along a line parallel to the axle assembly. First raised impact surfaces have a first raised impact surface thickness. Second raised impact surfaces form a continuous raised impact region and are coupled across the width of a roller assembly lobe at a distance from the first raised impact surfaces. Second raised impact surfaces have a second raised impact surface thickness that is less than the first raised impact surface thickness. First raised impact surfaces are positioned on a lobe such that the first raised impact surfaces contact a surface first and second raised impact surfaces are positioned such that the second raised impact surfaces contact the surface subsequent to the first raised impact surfaces contacting the surface.

The frame assembly may be configured with wear plates, z-axis suspension to allow multi-dimensional rotation, and an impact absorption assembly suitable for absorbing shock as the apparatus turns or changes direction. Advantageously, the impact absorption assembly may allow the apparatus to continue rotating within the frame assembly as the apparatus changes direction.

According to additional embodiments of the present invention, an apparatus for providing compaction, breaking and rubbilization is configured to provide quick release coupling with a plurality of vehicles suitable for towing or pushing the apparatus is disclosed. Each of these vehicles may be provided with a coupling assembly allowing for rapid engagement and disengagement of the apparatus and the vehicle. Apparatus may further be configured with a securing assembly suitable for securing the apparatus in an upright position within a shipping container.

Further embodiments of the present invention provide multiple apparatuses coupled laterally, in tandem or both to allow impact regions of any size. Multiple apparatus embodiments may be coupled in phase, out of phase, or any combination of in phase and out of phase, and may be coupled having any desired distance between individual apparatuses. In this manner, multiple apparatus embodiments provide configurations suitable for a plurality of applications.

According to a further additional aspect of the present invention, a method for manufacturing an apparatus suitable for providing compaction, breaking and rubbilization is disclosed. Method may comprise providing a first non-circular plate having a first plate flat portion and a first plate thickness. Method may further comprise providing a second non-circular plate having a second plate flat portion and a second plate thickness. The thickness of the second plate may be substantially equivalent to the first plate thickness. Method may also comprise providing a third plate having a third plate first flat portion and a third plate second flat portion. Third plate may further comprise a third plate thickness. Third plate thickness may be less than each of the first plate thickness and the second plate thickness. Method may further comprise coupling the first plate flat portion to the third plate first flat portion and coupling the second plate flat portion to the third plate second flat portion to form a non-circular plate weldment assembly in the shape of a non-circular multi-lobed roller.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Reference will now be made in detail to presently preferred embodiments of the invention, examples of which are illustrated in the accompanying drawings.

Figure 1:
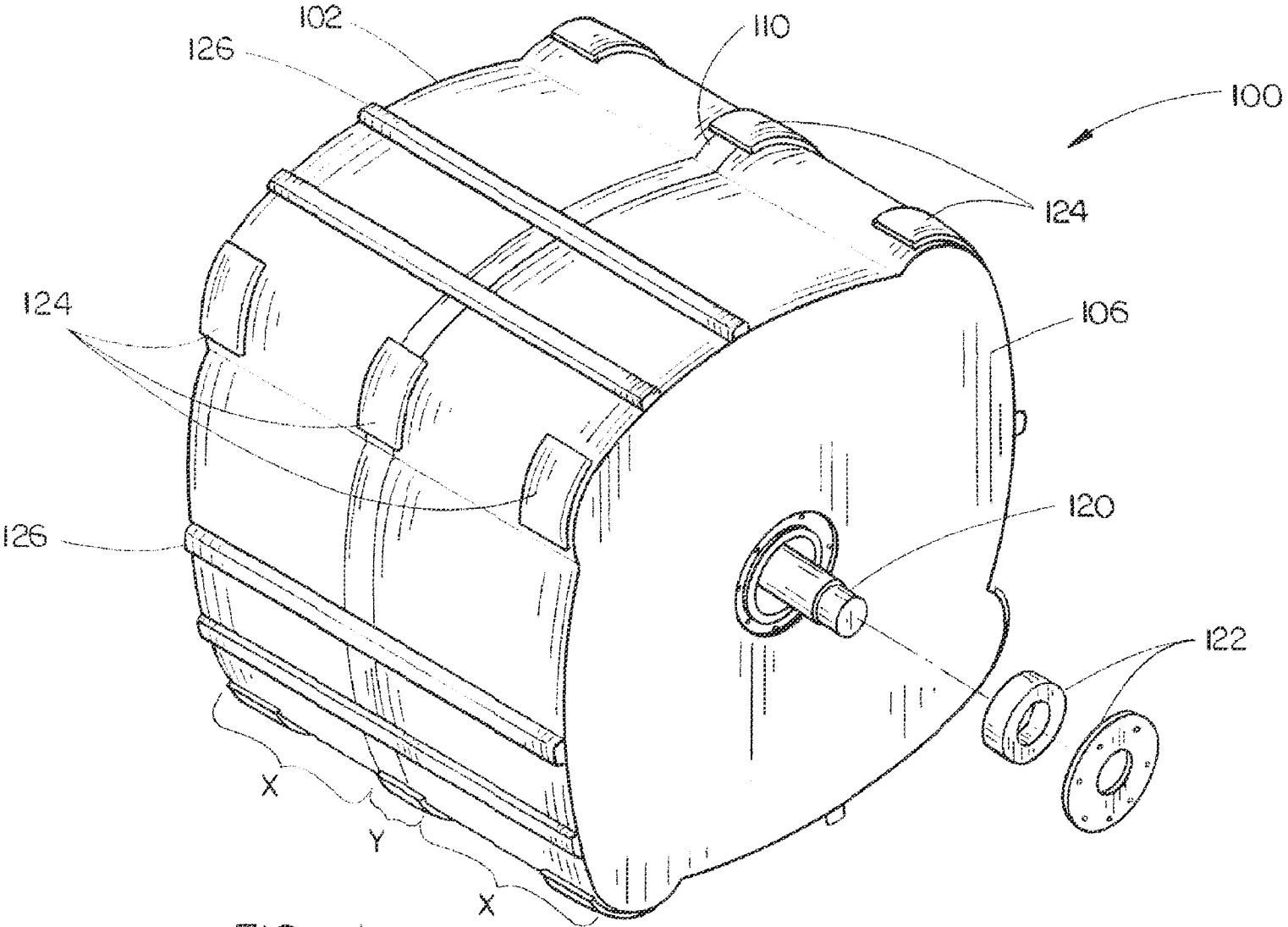
FIG. 1 is an isometric view of an assembled roller assembly of a material compaction, breaking and rubblizing apparatus according to an exemplary embodiment of the present invention.
Figure 2:
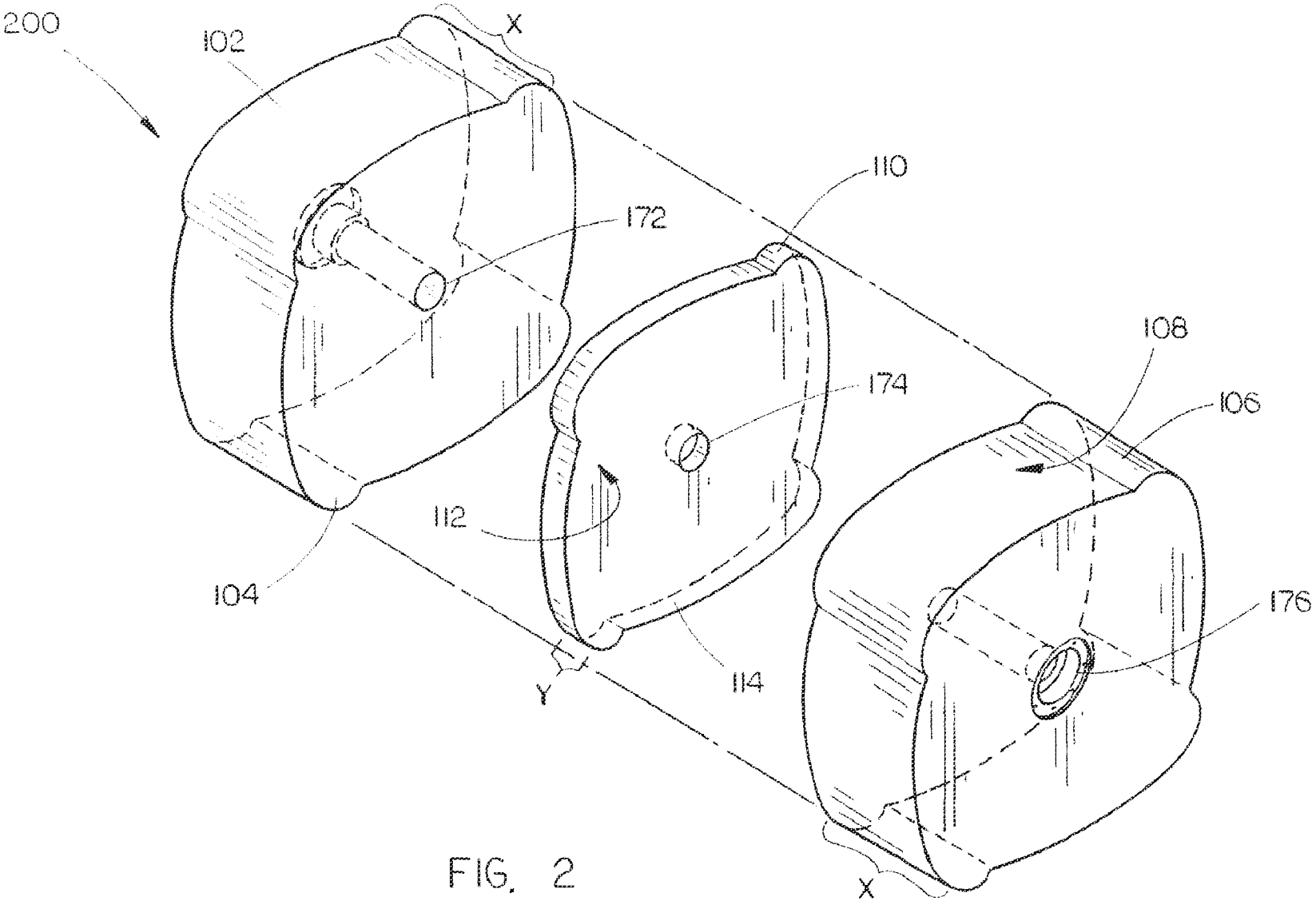
FIG. 2 is an isometric view of the roller assembly plate components of a material compaction, breaking and rubblizing apparatus according to an exemplary embodiment of the present invention.
Figure 3:
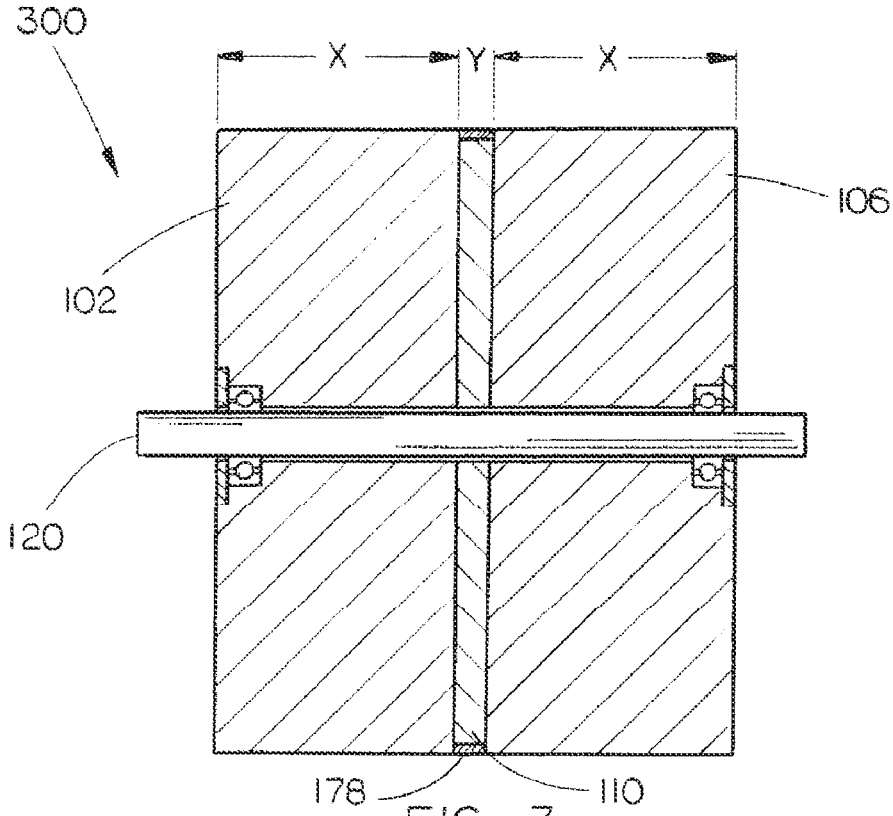
FIG. 3 is a cross sectional view of a roller assembly of a material compaction, breaking and rubblizing apparatus according to an exemplary embodiment of the present invention.

Referring now to FIG. 1, an isometric view of an assembled roller assembly 100 of a material compaction, breaking and rubblizing apparatus according to an exemplary embodiment of the present invention is shown. Referring to FIG. 2, an isometric view of the roller assembly plate components of a material compaction, breaking and rubblizing apparatus according to an exemplary embodiment of the present invention is shown. Referring to FIG. 3, a cross sectional view of a roller assembly 100 of a material compaction, breaking and rubblizing apparatus according to an exemplary embodiment of the present invention is shown. Roller assembly 100 may comprise a first non-circular plate 102 having a first plate flat portion 104 and a first plate thickness (x). Roller assembly 100 may further comprise a second non-circular plate having a second plate flat portion 108 and a second plate thickness (x). The thickness of the second plate 106 may be substantially equivalent to the first plate thickness (x). Roller assembly 100 may also comprise a third plate 110 having a third plate first flat portion 112 and a third plate second flat portion 114. Third plate 110 may further comprise a third plate thickness (y). Third plate thickness (y) may be less than each of the first plate thickness (x) and the second plate thickness (x).

To form a roller assembly 100 according to the present invention, the first plate flat portion 104 is coupled to the third plate first flat portion 112 and the second plate flat portion 108 is coupled to the third plate second flat portion 114. In a preferred embodiment, the first plate 102 and the second plate 106 may be welded to the third plate 110 to form a weldment. Each of the first plate 102 and the second plate 106 are configured to form a non-circular multi-lobed impact roller assembly 100 when coupled to the third plate 110.

The third plate 110 may be configured with a diameter that is less than the diameter of the first and second plates 102, 106. A weld material may be poured between the first plate 102 and the second plate 106 substantially about the perimeter of third plate 110 to fill in the region defined by the difference in diameters of the first and second plates and the third plate 110. Each plate is configured and to form four uniform lateral sides or lobes. The roller assembly 100 comprises a set first raised impact surfaces and a set of second raised impact surfaces. First raised impact surfaces form a non-continuous raised impact region across a width of the roller assembly 100, spaced a distance apart from one another across the width of the roller and projecting outwardly from the impact surface of each lobe along a line parallel to the axle. First raised impact surfaces have a first raised impact surface thickness. Second raised impact surfaces form a continuous raised impact region and are coupled across the width of the roller at a distance from the first raised impact surfaces. Second raised impact surfaces have a second raised impact surface thickness that is less than the first raised impact surface thickness.

Each of the first plate 102, the second plate and the third plate 110 may be formed from an alloy primarily made of iron, with a carbon content between 0.02% and 1.7% by weight, such as a steel material. Steel material may be high strength low alloy steel, having additions of other elements, such as typically 1.5% manganese, to provide additional strength. Steel material may also be alloyed with other elements, such as molybdenum, manganese, chromium, or nickel, in amounts such as 10% by weight to improve the hardenability of thick sections. Steel material may further comprise chromium, and nickel, to resist corrosion.

First, second and third plates 102, 106, 110 may be formed from any conventional material cutting process, particularly those suitable for cutting steel plates having a thickness of between 10 inches and 20 inches. For instance, plates may be torch cut utilizing a CAD/CAM plasma torch cutting apparatus.

Figure 4:
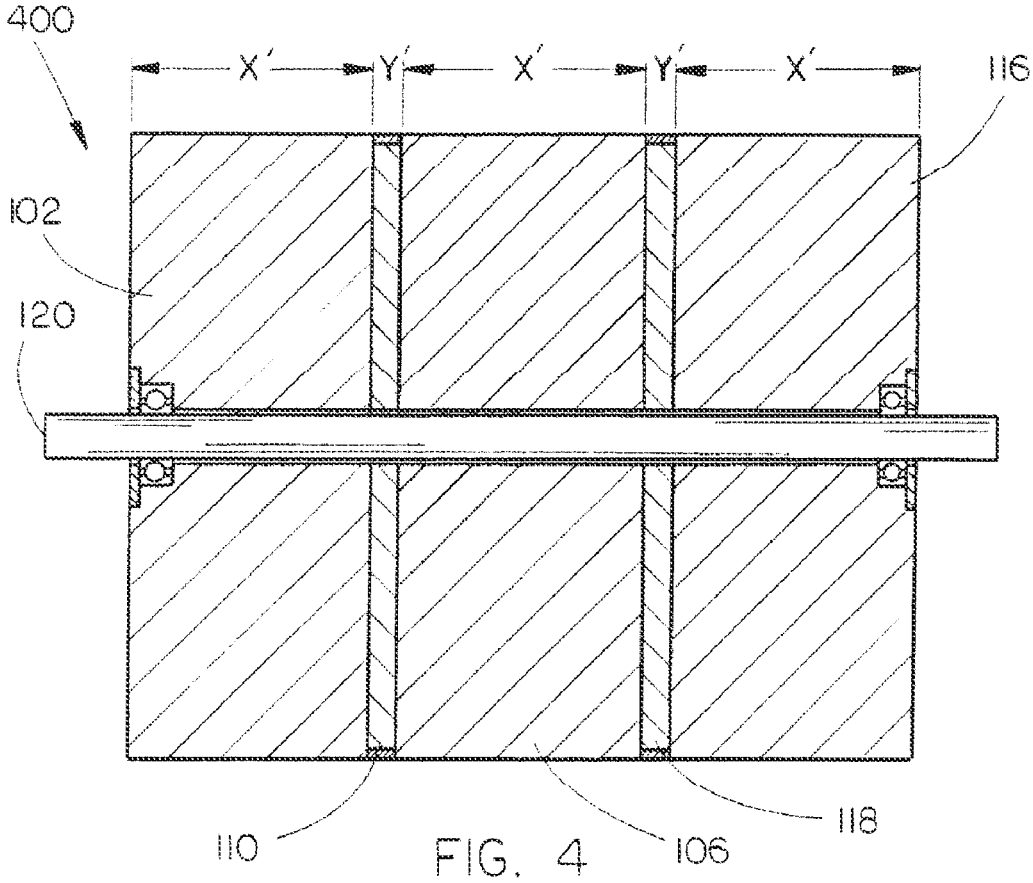
FIG. 4 is a cross sectional view of an additional embodiment of a roller assembly of a material compaction, breaking and rubblizing apparatus according to an exemplary embodiment of the present invention.

Referring to FIG. 4, a cross sectional view of an additional embodiment of a roller assembly 100 of a material compaction, breaking and rubblizing apparatus according to an exemplary embodiment of the present invention is shown. It is contemplated that roller assembly 100 may be formed from 4 or more plates as desired by an operator or required by an application. Roller assembly 100 may comprise any number of plates of alternating, varying or uniform thickness. Also, roller assembly 100 may be formed in a solid embodiment, wherein the steel or other metal is poured into a roller assembly mold. Solid steel roller assembly embodiment may be formed utilizing any molding technique appropriate for forming a solid steel roller assembly.

In an embodiment of the present invention, the first plate 102 and the second plate may be approximately 15 inches thick and the third plate 110 may be approximately 1 inch thick, forming a roller assembly 100 have a thickness of approximately 31 inches. It is contemplated, however that drum profile design and thickness may be modified for a variety of uses as may be required by material, geographic or like constraints, or the desires of the operator. For instance, first plate may be any width, second plate may be any width, and third plate may be any width such that the first, second and third plates may be of unequal thicknesses, as may be desired by an operator or required by an application.

Roller assembly 100 may further comprise a plurality of raised elements suitable for providing additional force to a surface when the roller assembly 100 is in motion. In a preferred embodiment, roller assembly 100 comprises at least one set of first raised impact surfaces and at least one second raised impact surface on each lobe of the roller assembly 100. First raised impact elements may have a first thickness and second raised impact elements may have a second thickness that is less than the first raised impact element thickness. First raised impact surfaces may be non-continuous, and may be intermittent raised elements such as cleats, bumps, or the like. Second raised impact surface may be continuously formed such that the second raised impact surface extends substantially across the entire width of a roller assembly lobe. Second raised impact surfaces may be steel bars such as steel keystock, mill stock, step keystock and the like. The first raised impact surfaces are slightly curved along a large radius, and thus is generally flat in character. The second raised impact surface is substantially flat and positioned to contact a material's surface after the first raised impact surface contacts the material's surface.

First raised impact surfaces are may be rectangular bars welded to the roller assembly 100 and oriented parallel to the rotational axis of roller. First raised impact surfaces are located generally centrally on an extended lobe section of the roller assembly 100, such that first raised impact surfaces 124 are the first members of the roller assembly 100 to contact a material's surface. As roller assembly 100 continues to turn, and the downward force of lobe continues, the second raised impact surface 126 impacts the material, and subsequently the remaining "flat" surface of the lobe will then contact the material's surface. Thus, first raised impact surfaces 124 and the second raised impact surfaces 126 are configured to bite into the material as the roller assembly 100 continues forward.

In an additional embodiment, each of the first plate 102, the second plate 106 and the third plate 110 may be formed with first and second raised impact elements 124, 126, and may be configured to be aligned in a configuration providing each lobe of the formed roller assembly 100 with at least one set of non-continuous first raised impact surfaces 124 and at least one continuous second raised impact surface 126.

Lobes may be spaced at 90 degrees from one another relative to axis, and having a maximum radius R. The multi-lobed roller is suitable for rotatably mounting on an axle. In one embodiment, the axle is mounted on a frame to follow the frame as the frame moves along the ground. Each of the non-continuous raised impact surfaces and the continuous raised impact surfaces are suitable for contacting the ground as the roller assembly 100 rotates on the axle.

Each lateral surface or lobe may also comprise a pivot surface, and a "dead" area. The pivot surfaces are curved to a short radius, and serve as a fulcrum as the following lobe swings overhead and thence towards the ground. The dead area may provide additional smoothing after an area has been impacted.

Roller assembly 100 may be utilized for material compaction, breaking and rubbilization by rolling the roller assembly 100 along the ground. According to a first embodiment, roller assembly 100 may weigh from 22,000-40,000 pounds, and may be rolled at speeds between of 4-10 miles per hour. Each lobe causes the rotational axis to rise relative to the ground, thereby causing a larger dynamic impact force along the impact surfaces of each lobe.

Figure 5:
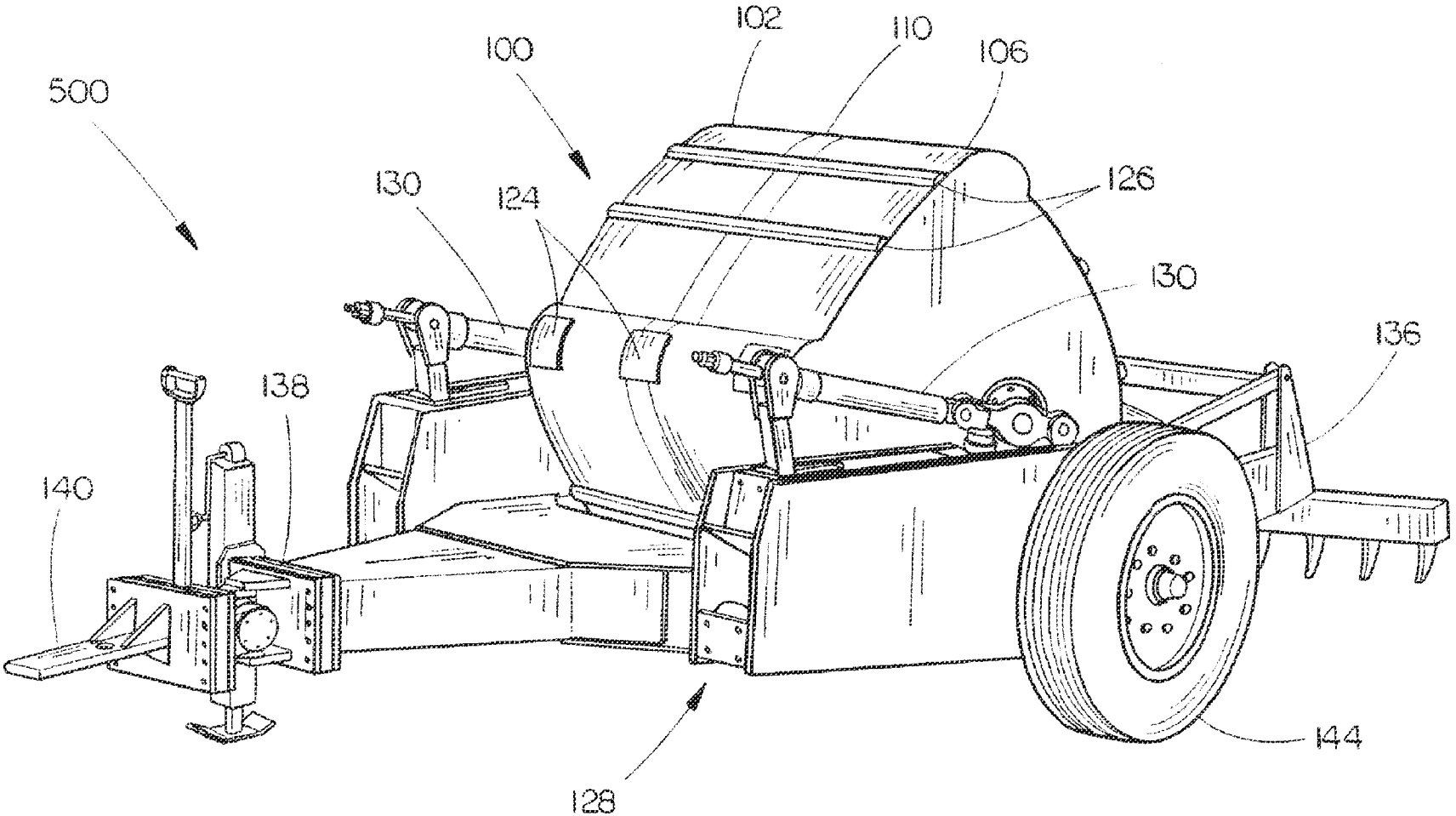
FIG. 5 is an isometric view of a material compaction, breaking and rubblizing apparatus according to an exemplary embodiment of the present invention.
Figure 6:
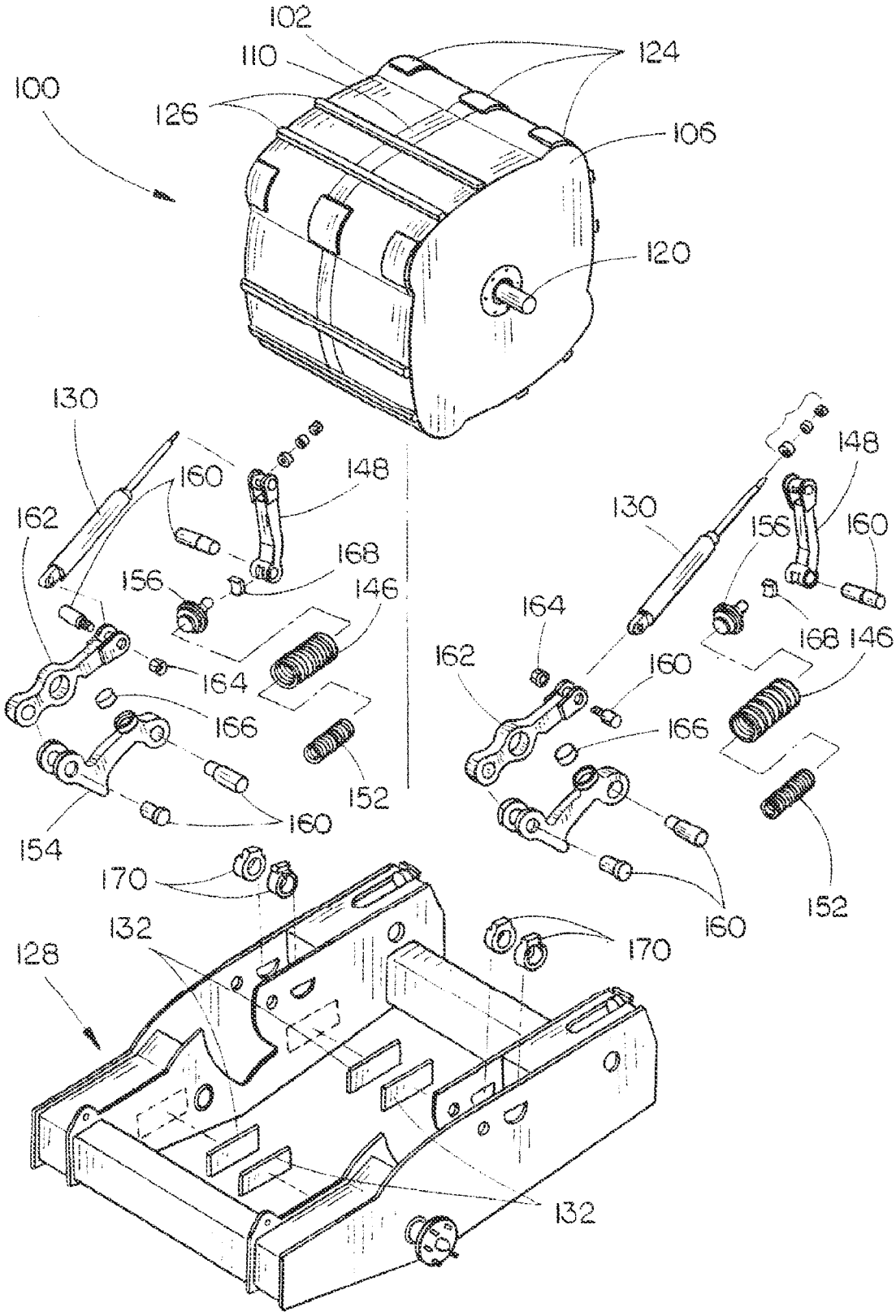
FIG. 6 is an isometric view of a material compaction, breaking and rubblizing apparatus according to an exemplary embodiment of the present invention, showing the coupling assembly components utilized to couple the roller assembly to the frame assembly.
Figure 7A:
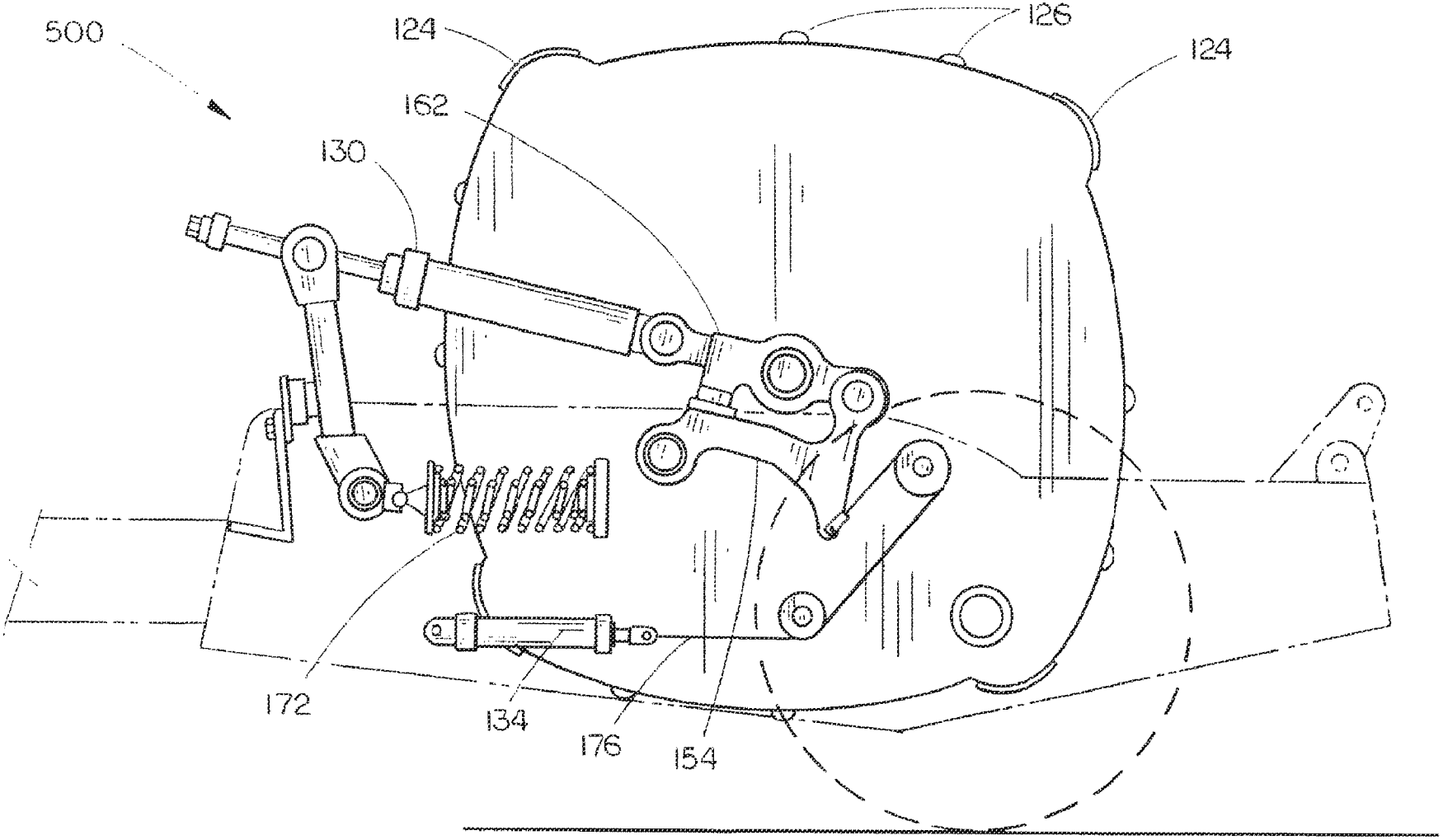
FIGS. 7A and 7B are side views of a material compaction, breaking and rubblizing apparatus according to an exemplary embodiment of the present invention.
Figure 7B:
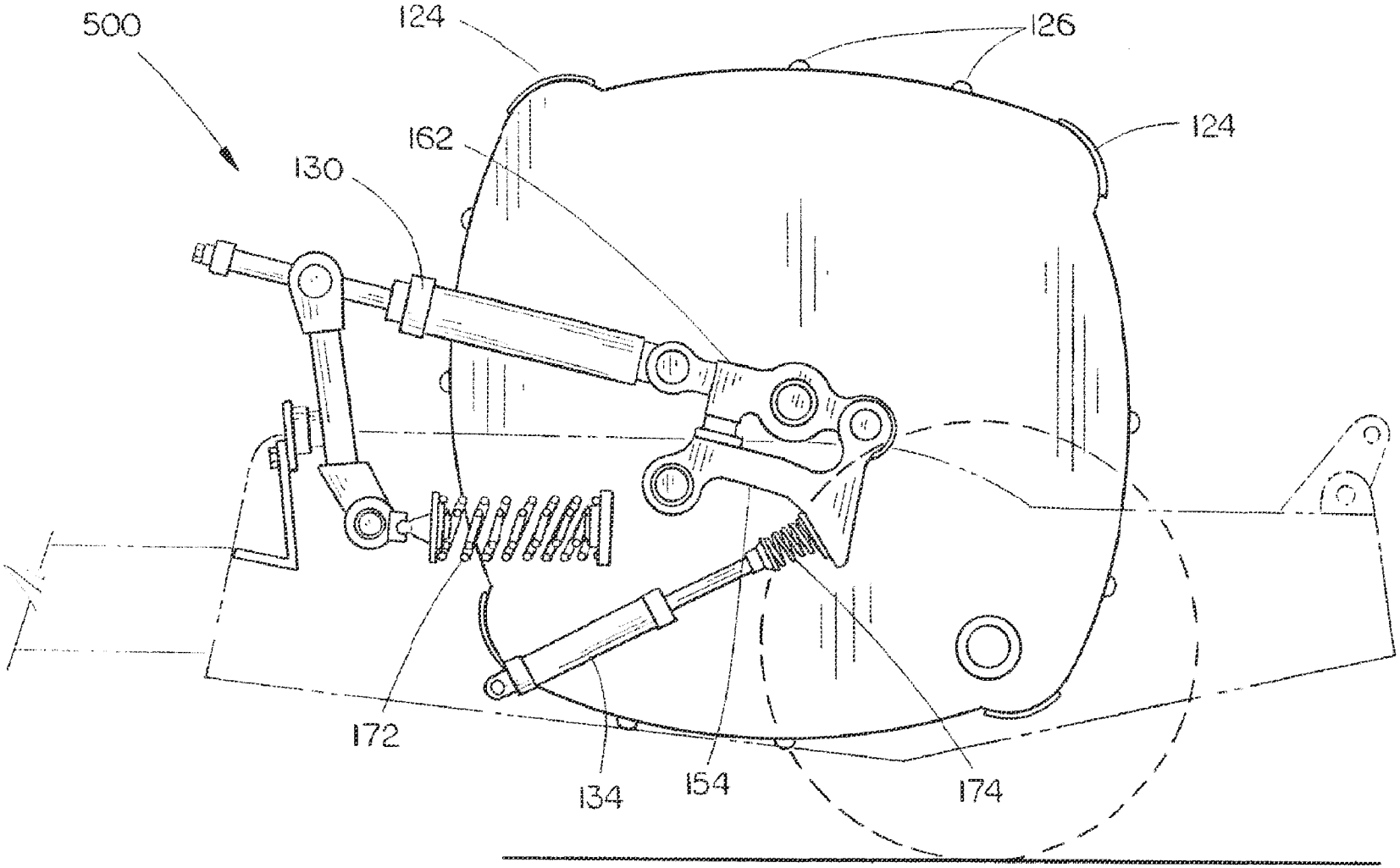
Figure 8:
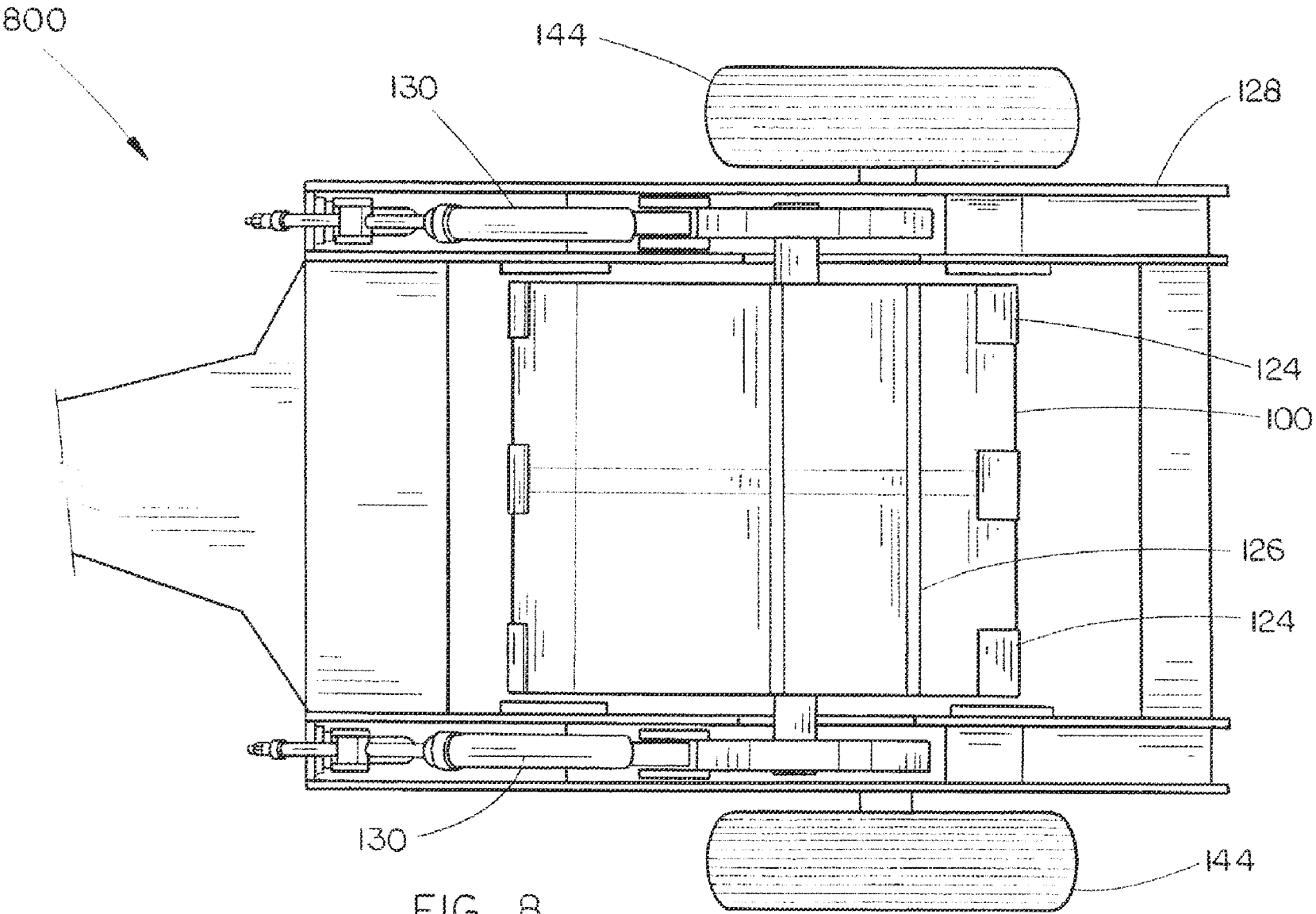
FIG. 8 is a top view of a material compaction, breaking and rubblizing apparatus according to an exemplary embodiment of the present invention.

Referring to FIGS. 5-8, views of an apparatus according to an exemplary embodiment of the present invention comprising a roller assembly 100 and a frame assembly 128 is shown. Specifically, FIG. 5 is an isometric view of a material compaction, breaking and rubblizing apparatus according to an exemplary embodiment of the present invention. FIG. 6 is an isometric view of a material compaction, breaking and rubblizing apparatus according to an exemplary embodiment of the present invention, showing the coupling assembly components utilized to couple the roller assembly 100 to the frame assembly 128. FIG. 7 is a side view of a material compaction, breaking and rubblizing apparatus according to an exemplary embodiment of the present invention, and FIG. 8 is a top view of a material compaction, breaking and rubblizing apparatus according to an exemplary embodiment of the present invention.

As discussed above, apparatus 500 may further comprise a frame assembly 128. Frame assembly 128 may comprise a spring assembly 130 suitable for providing adequate force needed to initiate and maintain rolling motion of the roller assembly 100. Spring assembly 130 may be coupled to the axle assembly 120 of the roller assembly 100 via a linkage system 162. Spring assembly 130 may comprise at least one, or preferably, a plurality of individual concentric springs, where a first spring is suitable for insertion through a second spring, a second spring is suitable for insertion through a third spring, and the like. Spring assembly 130 may be suitable for compressing as the roller assembly 100 forward motion is initiated by the transporting assembly. Compression of the spring assembly causes the requisite build up of potential energy, which is then converted into kinetic energy in the form of the roller assembly 100 rotating about the axle assembly 120. Because the roller assembly 100 is non-circular, this energy conversion is necessary for the rotation of the roller assembly 100 about the axle assembly 120. Spring assembly may further comprise a damping assembly suitable for minimizing sudden horizontal motion of the roller assembly 100 when the roller assembly 100 is being pulled or pushed forward.

Referring to FIGS. 5-7B, and as described above, rolling assembly 100 is mountable to and rotatable within the frame assembly 128. Referring specifically to FIG. 6, a plurality of coupling components suitable for providing coupling of the rolling assembly 100 and the frame assembly are shown. Axles 120, located on both substantially exterior lateral portions of the rolling assembly 100 are configured to be inserted into frame assembly slots 138.

A spring assembly may induce forward motion of the roller assembly 100 within the frame assembly 128. In one embodiment, spring assembly is an assembly of concentric springs. For instance, small spring 152 may be configured to be inserted into larger spring 146. It is further contemplated that spring assembly may comprise a plurality of concentric springs. Springs may be coupled to the rolling assembly and the frame assembly via a plurality of coupling components 156, 160 168 such as bolts, screws, nuts, dowels and the like and may be mountable onto spring coupling plates 148. Hydraulic assembly 130 may be mountable onto hydraulic assembly coupling plates 154, 162 via a plurality of coupling components 160, 164, 166 and may be mounted onto the frame assembly via mounting components 170.

A grading assembly 136 may be coupled to a rear portion of the frame assembly 128. Grading assembly 136 may be suitable for grading the surface of a material after the rolling assembly has compacted or broken up the surface.

Referring to FIG. 6, frame assembly 128 may comprise wear pads 132 suitable for reducing wear that may be cause by the rotational motion of the roller assembly 100 on the axle. Wear pads 132 may be neoprene, Teflon, or any material suitable for reducing friction between the roller assembly 100 and the frame assembly. One or more wear pads 132 may be releasably mounted to the frame assembly 128 to and may be replaced as the pads wear down or as desired by an operator.

Referring specifically to FIGS. 7A and 7B, apparatus 500 may comprise a shock absorption assembly suitable for absorbing shock as the apparatus is turning. When apparatus 500 makes multiple passes over a length of material, it is often necessary to turn the apparatus around to pass over the same region. This generally requires an operator to stop the apparatus 500, lift it via a hydraulic lifting assembly and turn the vehicle and apparatus. If an operator does not stop and lift the apparatus prior to turning the apparatus around, the hydraulic lifting assembly and other frame components may become damaged as the apparatus turns. Shock absorption assembly may prevent or substantially reduce damage and wear by absorbing some or all of the shock caused by turning the apparatus. To this end, shock absorption assembly may comprise a pulley system suitable for providing a one-way tension linkage for the frame assembly. Referring specifically to FIG. 7B, shock absorption assembly may further comprise a shock absorption spring assembly suitable for compressing to further minimize shock effects from directional changes of the apparatus.

The roller assembly 100 may be utilized to break up, crush and rubblize material such as stone, rock, concrete and the like into rubble if it is operated in a particular method, as described in more detail below. As the roadway is rubblized according to the method of this invention, it was found that the roller would frequently slide on the rubble surface, rather than roll. The same thing was found to occur along other types of road surfaces such as sand or gravel roads, as the road was attempted to be compacted. To overcome this problem, a series of gripping raised impact surfaces were added to each lobe of the roller. Raised impact surfaces are also generally rectangular in shape and located generally centrally between the raised impact surfaces and the forwardly adjacent pivot surface of the next lobe. Thus, the first set of raised impact surfaces contact and break the roadway surface first, then the remaining flat surface of the impact surface, and the gripping raised impact surfaces will contact the roadway surface. This additional set of raised impact surfaces has been found sufficient to prevent the roller from sliding along the surface of the roadway, while assisting in the crushing and rubblizing of the concrete roadway surface. These additional gripping raised impact surfaces permit use of the roller assembly 100 of the present invention in a new way, to compact road surfaces of sand, dirt or gravel. This is typically necessary as a step in refurbishing county roads. Without the impact surfaces of varying thickness, such as those of the present invention, the roller could not be used for such a task, because the roller would simply slide along the road rather than rolling, gripping and compacting the surface.

Figure 9:
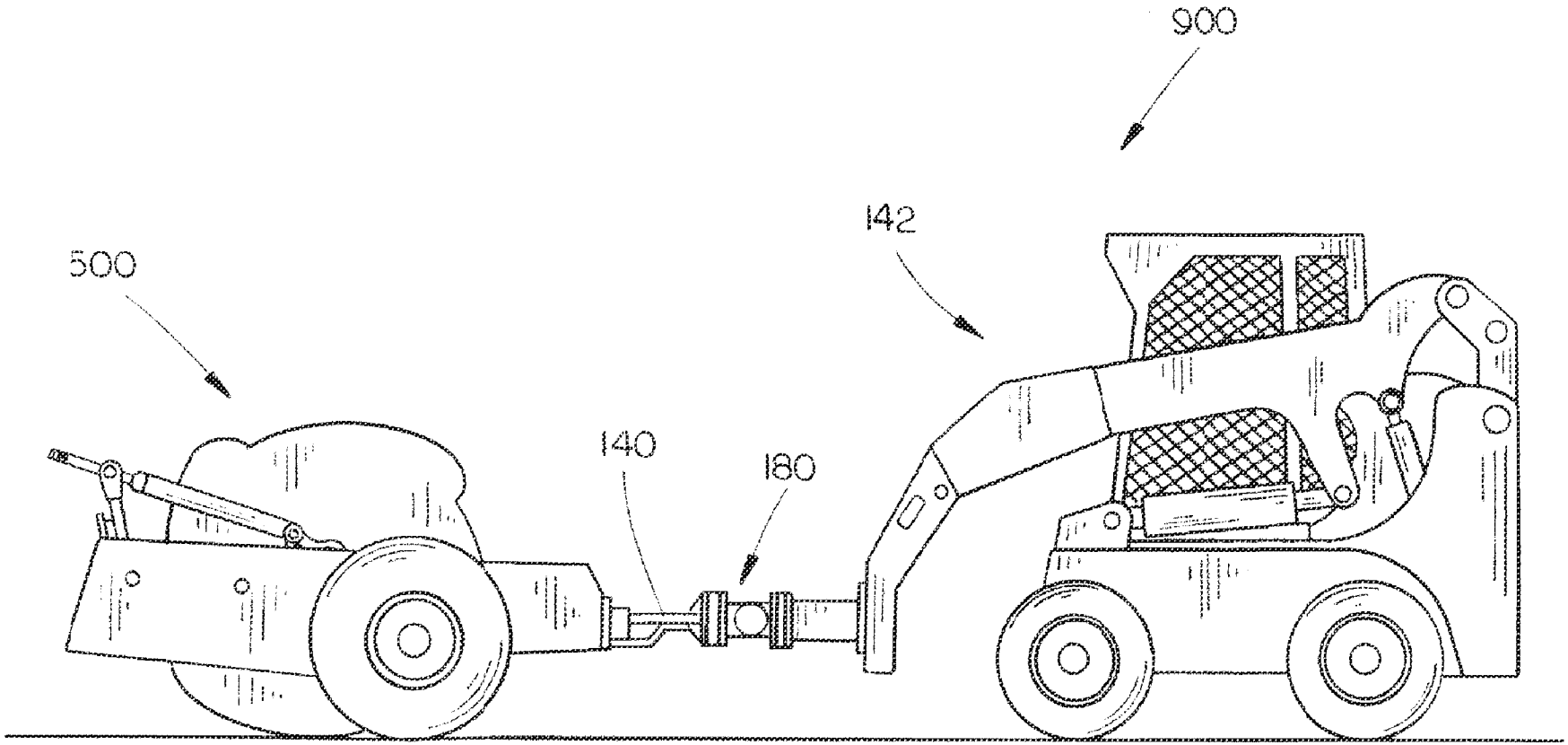
FIG. 9 is a side view of a material compaction, breaking and rubblizing apparatus coupled to a tractor according to an exemplary embodiment of the present invention.
Figure 10A:
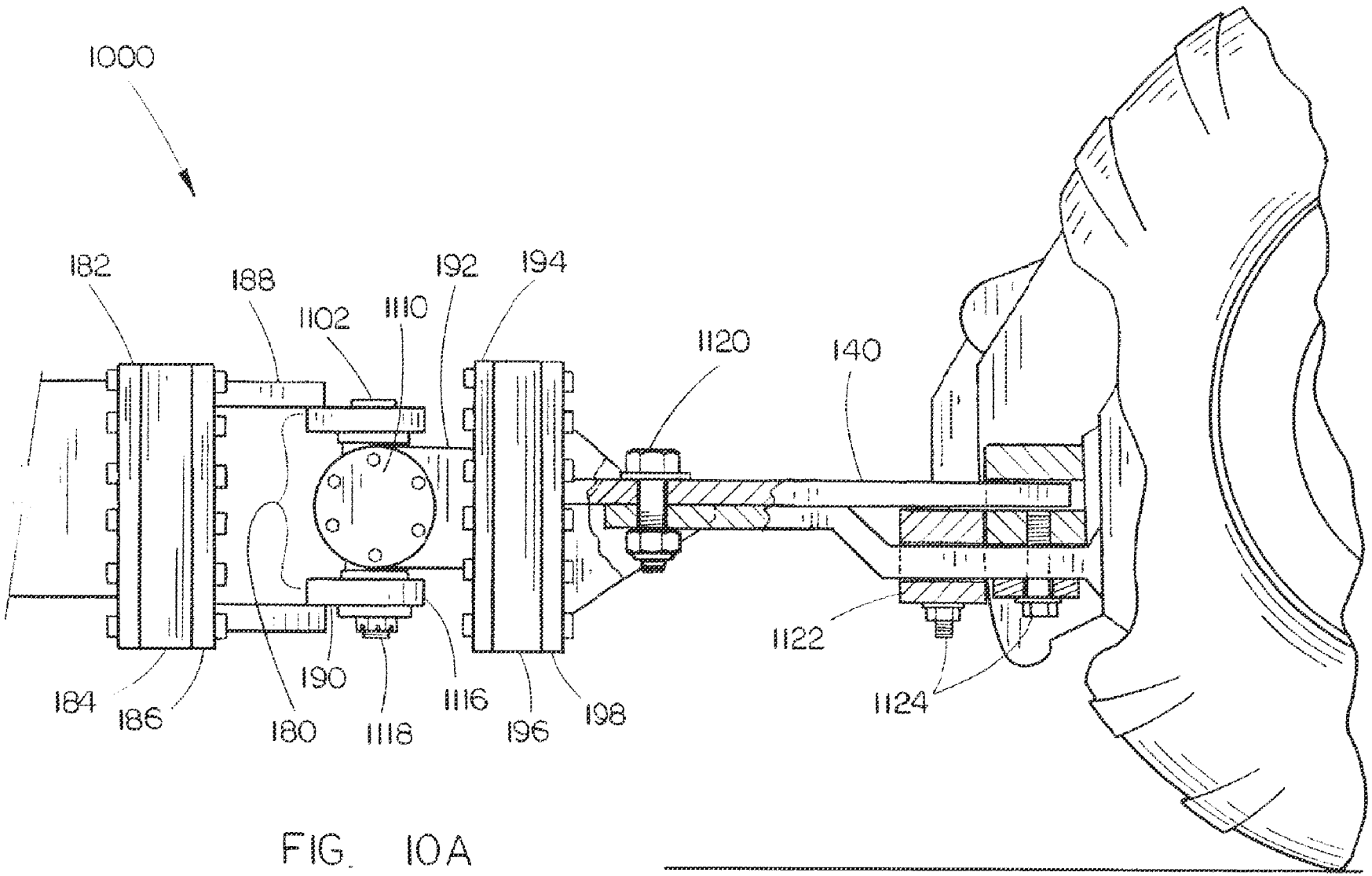
FIG. 10A is a side view of a material compaction, breaking and rubblizing apparatus hitch assembly according to an exemplary embodiment of the present invention.
Figure 10B:
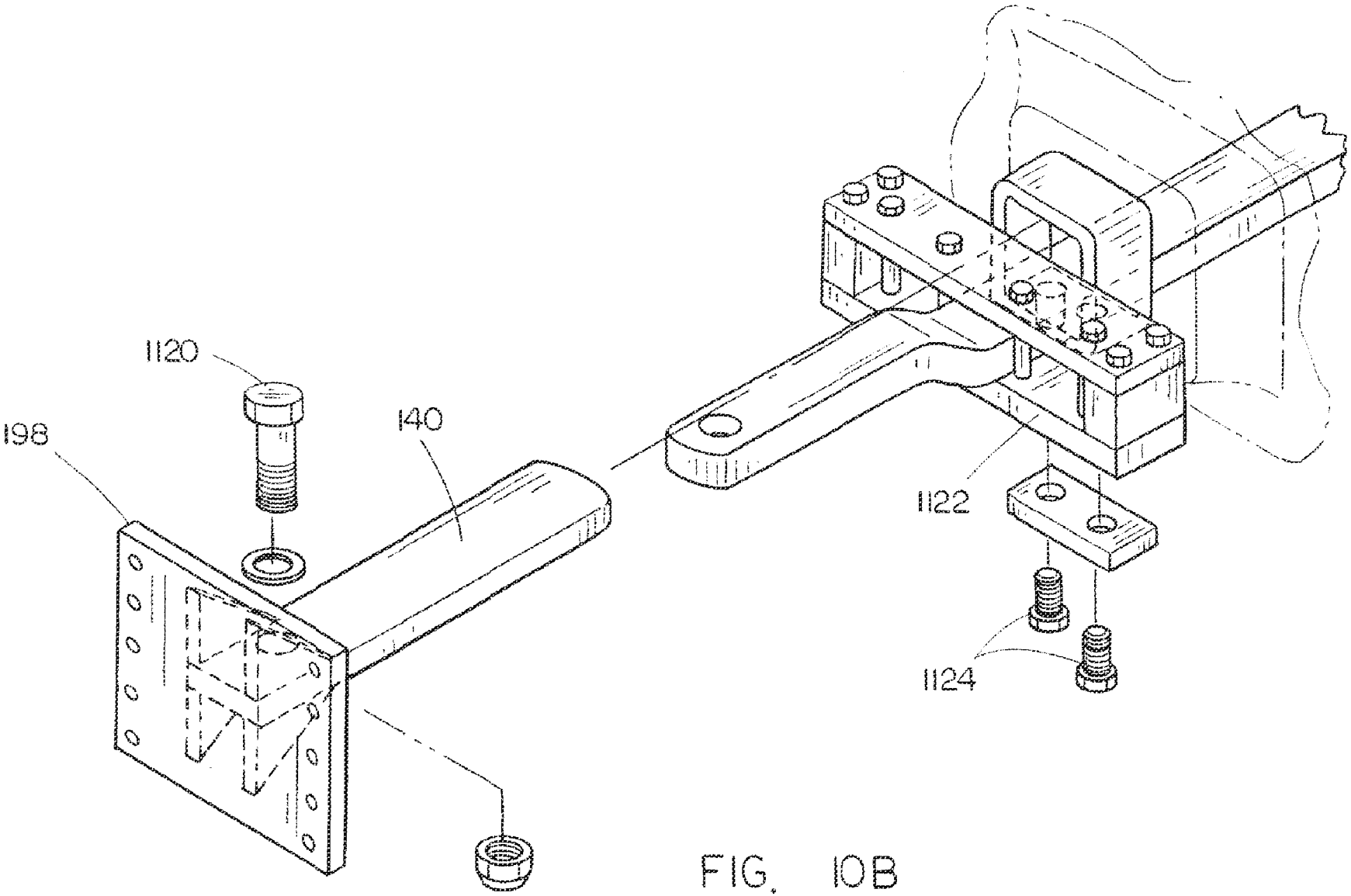
FIG. 10B is an exploded view of a material compaction, breaking and rubblizing apparatus hitch assembly according to an exemplary embodiment of the present invention.
Figure 11:
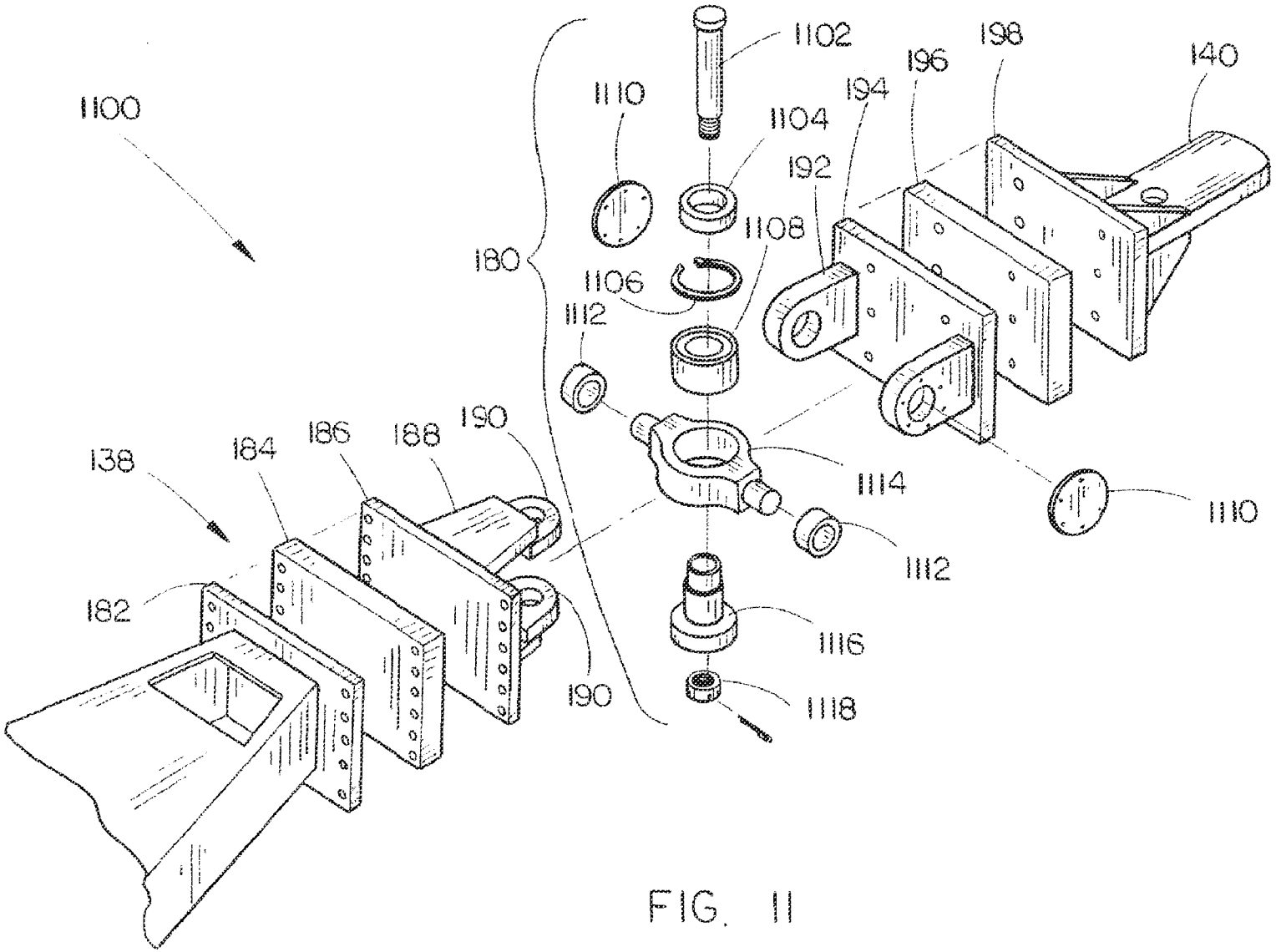
FIG. 11 is an isometric view of a material compaction, breaking and rubblizing apparatus swivel hitch assembly according to an exemplary embodiment of the present invention, showing the hitch coupling assembly components utilized to couple the apparatus to a vehicle.

Referring now to FIGS. 9-11, illustrations of an apparatus 500 mounted to a motion inducing device 142 is shown. FIG. 9 is a side view 900 of a material compaction, breaking and rubblizing apparatus 500 coupled to a tractor 142 according to an exemplary embodiment of the present invention.

Referring now to FIGS. 10A and 10B, views of a material compaction, breaking and rubblizing apparatus hitch assembly 1000 according to an exemplary embodiment of the present invention are shown. Hitch assembly 1000 may further comprise a bolt assembly 1120 suitable for attaching to a tongue assembly 140 suitable for insertion into a hitch coupling slot 1122 of a vehicle. When tongue assembly 140 is inserted into hitch coupling slot 1122, tongue assembly 140 may be secured by a plurality of securing devices 1124 such as screws, bolts or the like.

FIG. 11 is an exploded isometric view of a material compaction, breaking and rubblizing apparatus swivel hitch assembly 1100 according to an exemplary embodiment of the present invention, showing the hitch assembly 1100 components utilized to couple the apparatus to a vehicle. A frame assembly 128 may be coupled to a hitch assembly 1100 suitable for coupling the frame assembly to a vehicle for inducing rotating motion of the rolling assembly. Swivel hitch assembly 100 may comprise a plurality of components 180-198, 1102-1118 coupled to provide secure rotatable attachment of the frame assembly to the hitch assembly. Compaction, breaking and rubblizing apparatus may be mountable to any apparatus suitable pushing or towing the apparatus and driving or moving over a surface, such as a tractor, a bobcat a skid loader, back hoe, excavator, a passenger motor vehicle and the like. Attachments such as the hitch assembly may be modified or configured to provide attachment to the front or back end of any desired vehicle. Vehicle may be motorized or non-motorized. Advantageously, roller assembly 100 may be formed having a smaller profile, allowing for coupling to any a compact, low capacity machine used for pushing or lifting material. Frame assembly may comprise a coupling mechanism suitable for coupling with any apparatus suitable for initiating motion of the roller assembly 100. In one embodiment, frame assembly may comprise a quick suspension coupling assembly suitable for coupling the apparatus 500 to a plurality of apparatuses for pushing or pulling the roller assembly. Coupling assembly be configured to slide over any hitch assembly that may be connected to, for instance, a tractor, bobcat, skid loader, car, truck Coupling assembly may comprise a cavity suitable for sliding over a hitch assembly and at least one hitch pin suitable for insertion through apertures formed on opposite portions of the coupling assembly. Apertures may be configured to line up with apertures on a hitch assembly, and may be pre-formed, or formed when it is desired to couple the frame assembly to the hitch assembly.

Figure 12A:
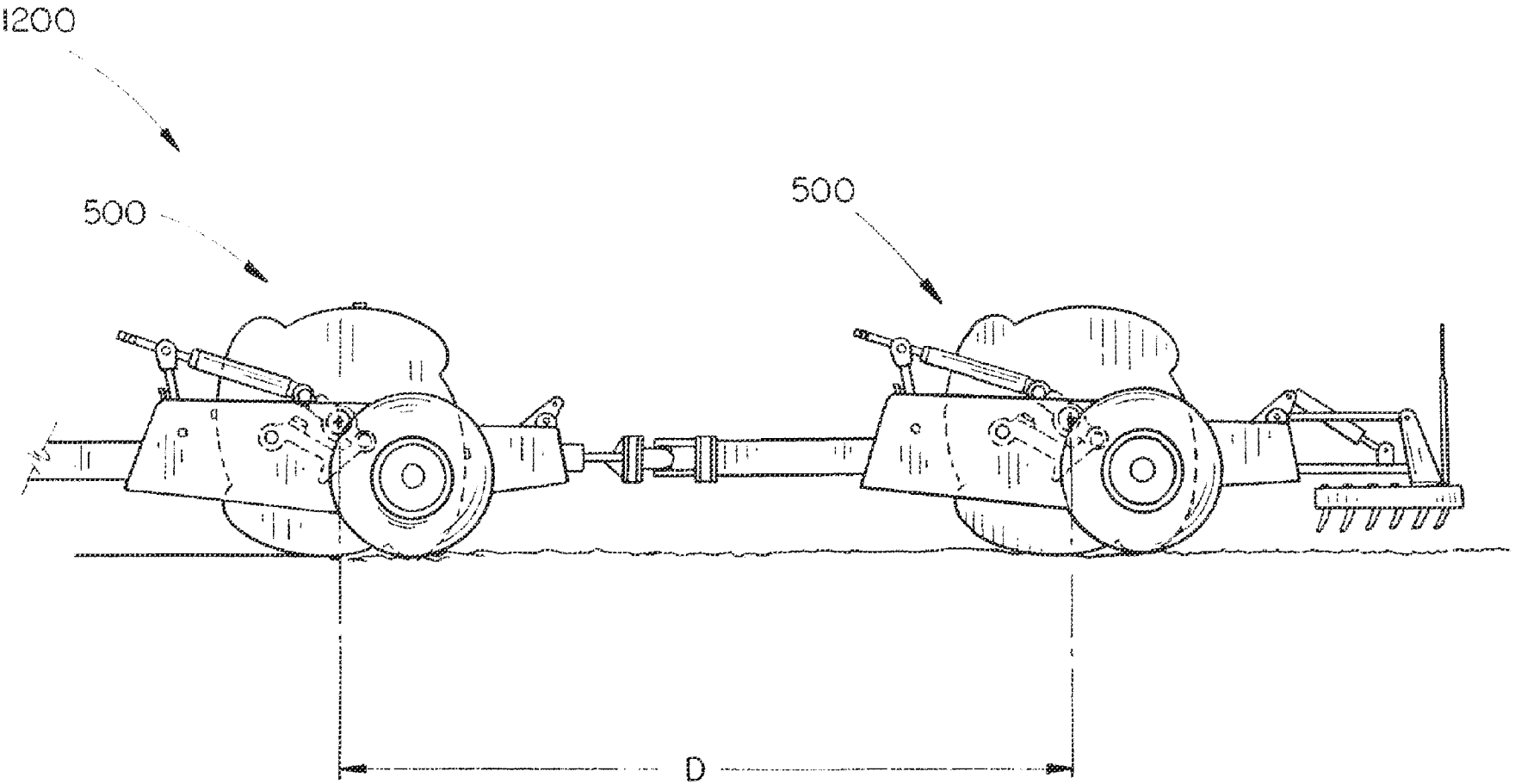
FIG. 12A is a side view of a plurality of material compaction, breaking and rubblizing apparatuses coupled in tandem and in phase according to an exemplary embodiment of the present invention.
Figure 12B:
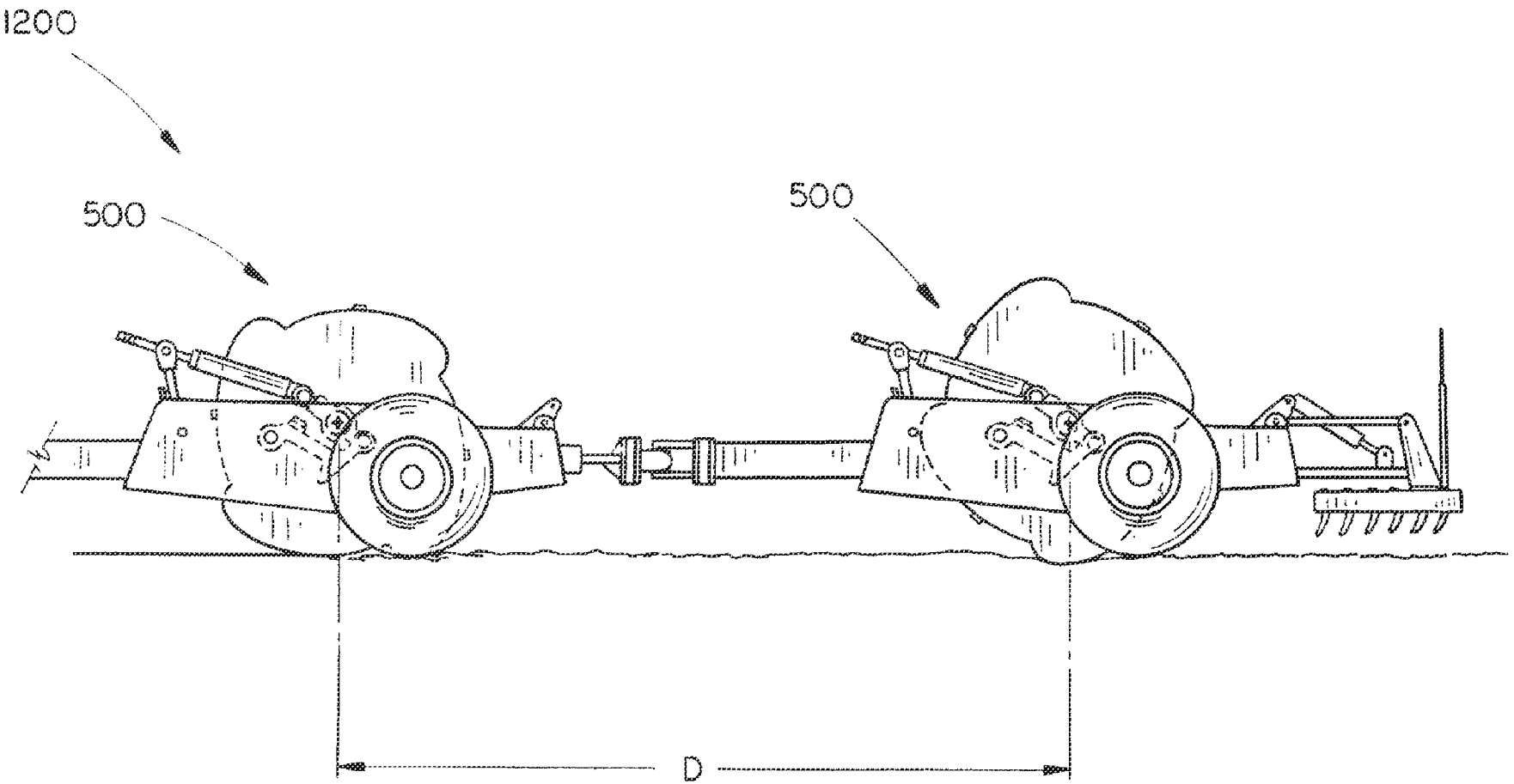
FIG. 12B is a side view of a plurality of material compaction, breaking and rubblizing apparatuses coupled in tandem and out of phase according to an exemplary embodiment of the present invention.
Figure 13:
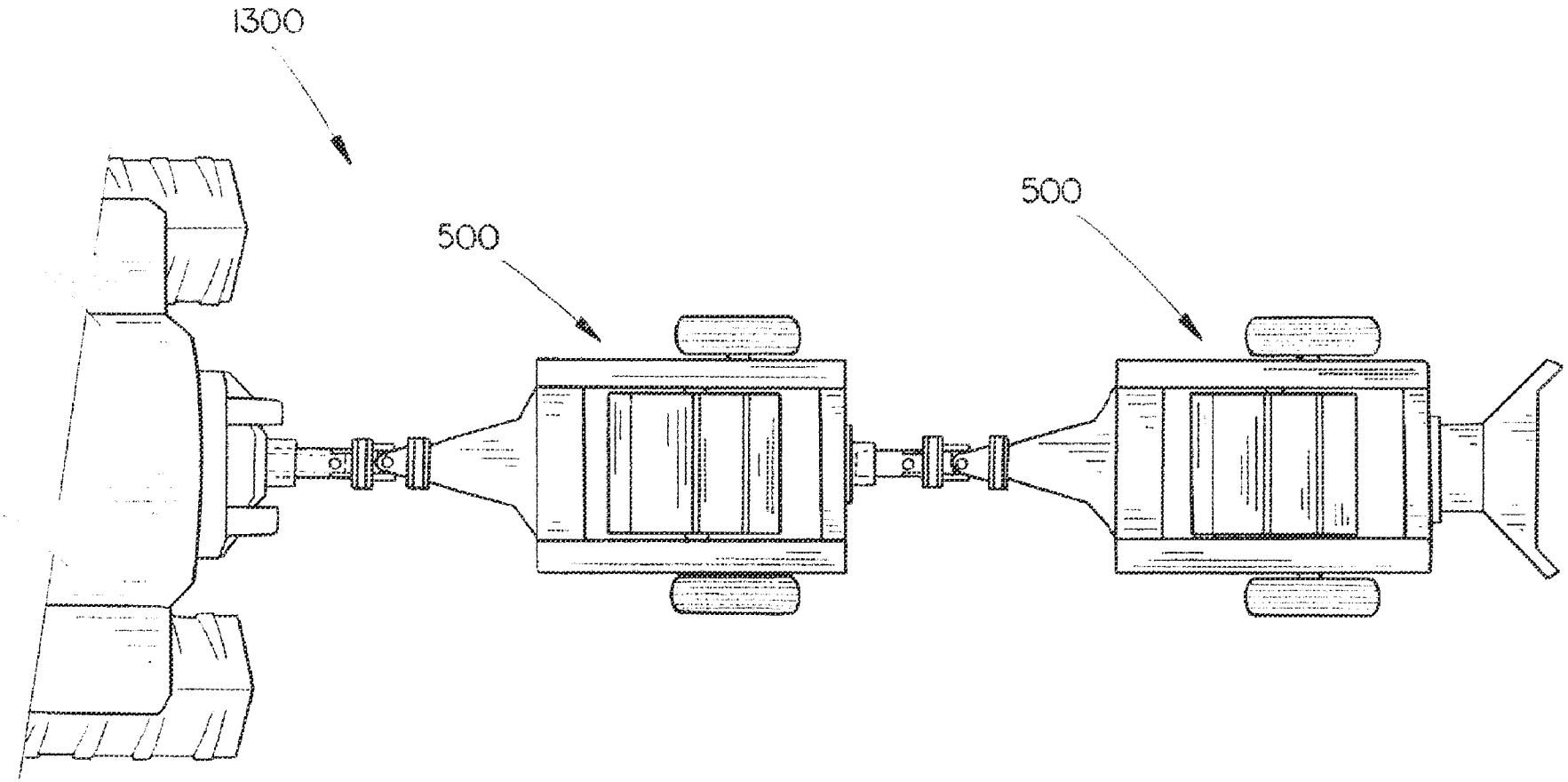
FIG. 13 is a top view of a plurality of material compaction, breaking and rubblizing apparatuses coupled in tandem according to an exemplary embodiment of the present invention.
Figure 14:
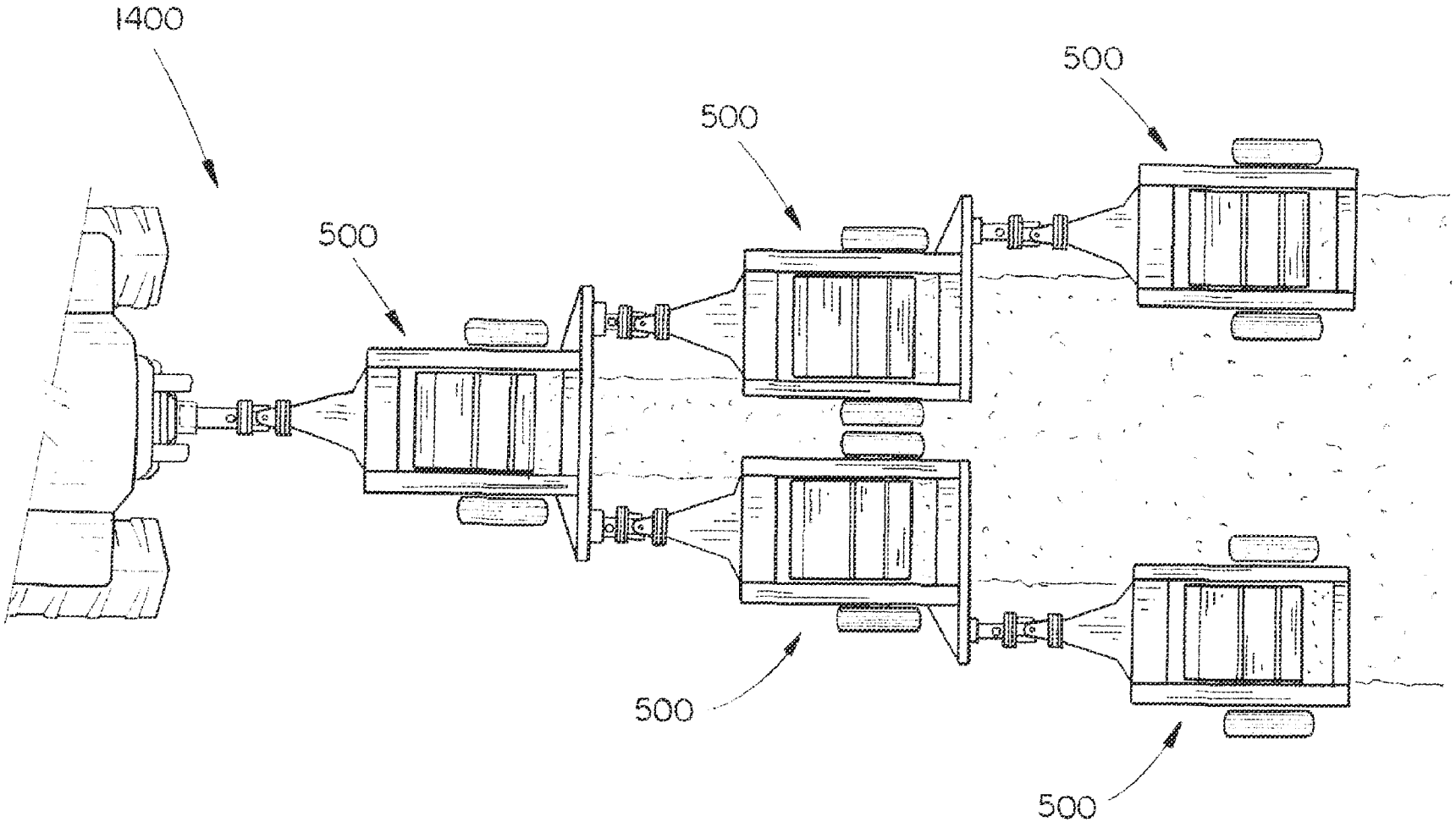
FIG. 14 is a top view of a plurality of material compaction, breaking and rubblizing apparatuses coupled laterally and in succession according to an exemplary embodiment of the present invention.

Referring to FIGS. 12-14, illustrations of a plurality of roller assemblies 100 mounted in tandem or laterally and in tandem are shown. FIG. 12A is a side view 1200 of a plurality of material compaction, breaking and rubblizing apparatuses coupled in tandem and in phase according to an exemplary embodiment of the present invention. FIG. 12B is a side view 1200 of a plurality of material compaction, breaking and rubblizing apparatuses coupled in tandem and out of phase according to an exemplary embodiment of the present invention. FIG. 13 is a top view 1300 of a plurality of material compaction, breaking and rubblizing apparatuses 500 coupled in tandem according to an exemplary embodiment of the present invention. Referring to FIGS. 12A and 12B, multiple apparatuses 500 coupled in tandem may be spaced apart any length D as required by an operation or desired by an operator. FIG. 14 is a top view 1400 of a plurality of material compaction, breaking and rubblizing apparatuses 500 coupled laterally and in succession according to an exemplary embodiment of the present invention. Apparatuses coupled laterally and in succession may be coupled in any combination of physical distance from one another and phase difference from one another. Each apparatus of a multiple apparatus embodiment may comprise a roller assembly, a frame assembly and a compressible motion initiation assembly. Roller assemblies mounted in tandem or side-by-side may be mounted in phase or out of phase with one another. Specifically, for embodiments where the roller assemblies are mounted in tandem, the projecting raised impact surfaces and the full length impact bars of each roller assembly may be configured to impact the ground at the same location, or at positions substantially behind a previous roller assembly impact.

Figure 15:
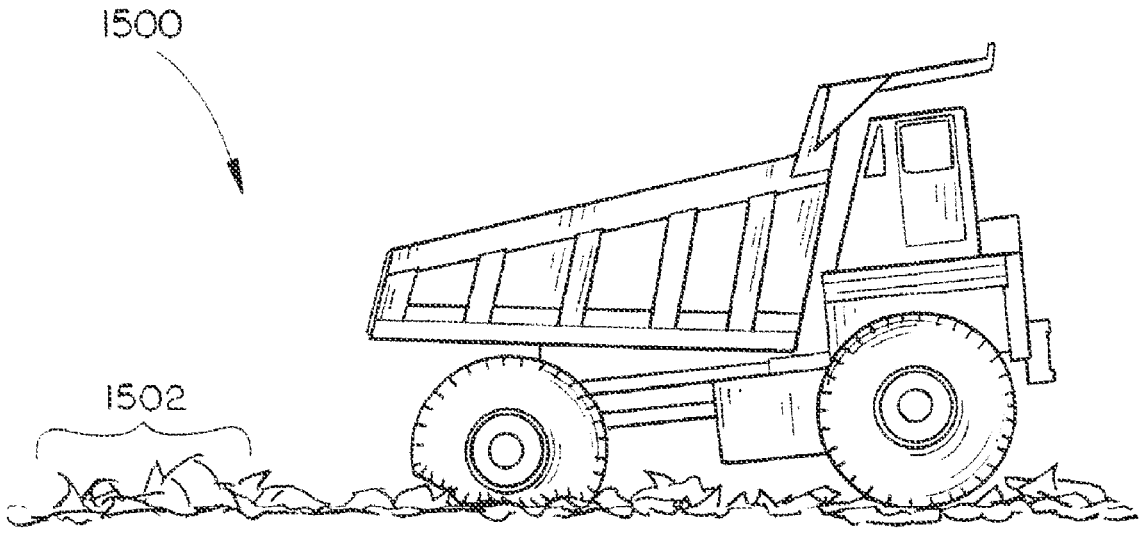
FIG. 15 (PRIOR ART)
FIG. 15 is a side view of a mining site illustrating a dump truck driving over a large rock surface.
Figure 16:
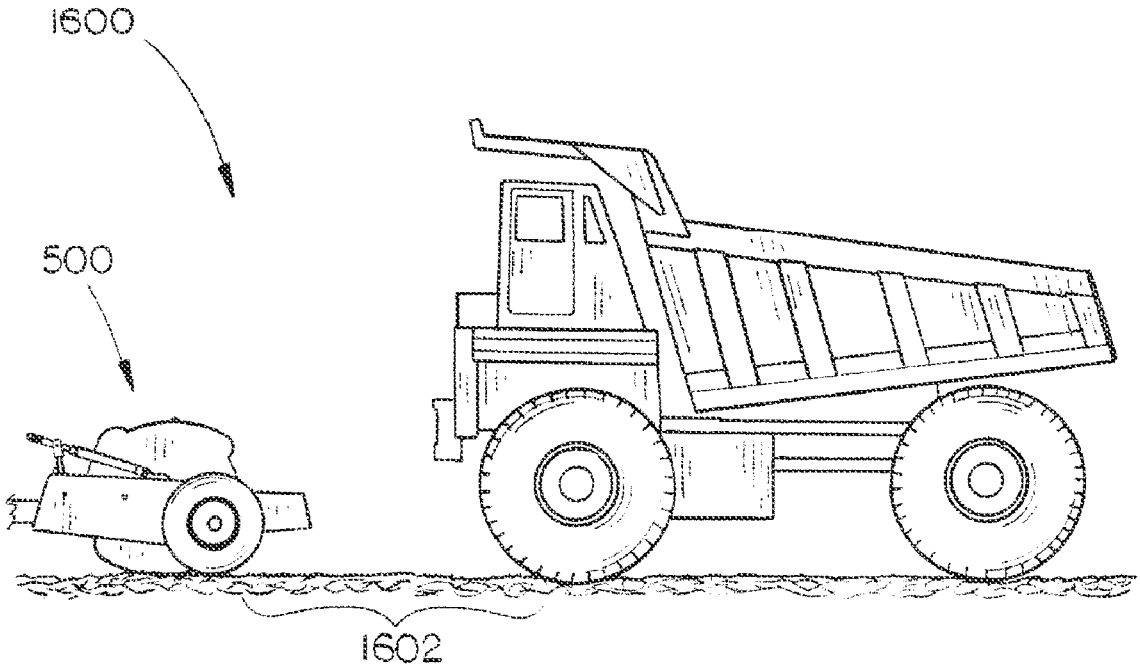
FIG. 16 is a side view of the mining site illustrating the dump truck driving over the surface after an apparatus according to an exemplary embodiment of the present invention has rubblized the surface.

Referring to FIGS. 15-16, illustrations of a mining setting before and after an apparatus according an exemplary embodiment of the present invention has been utilized is shown. Specifically, FIG. 15 is a side view of a mining site 1500 illustrating a dump truck driving over a surface of large rocks 1502. In a mining setting, such as an ore or mineral mine, excavation of large rocks and material is necessary to mine for the desired material. Such excavation typically leaves piles of large rocks, boulders and the like around the mine site. The tires on the vehicles utilized to remove the rock materials often become distressed and damaged due to the constant impact between the tires and the large rock material. FIG. 16 is a side view of the mining site 1600 illustrating the dump truck driving over the surface 1602 after an apparatus according to an exemplary embodiment of the present invention has rubblized the surface. Apparatus may be configured to operate in conjunction with a rock removal device, or may be utilized prior to rock removal to substantially break apart or crush large rock deposits, thereby reducing the wear on vehicle tires. Apparatus may be configured in a size range suitable for navigating the often narrower passageways, roadways and paths leading to and surrounding a mining site.

Figure 17:
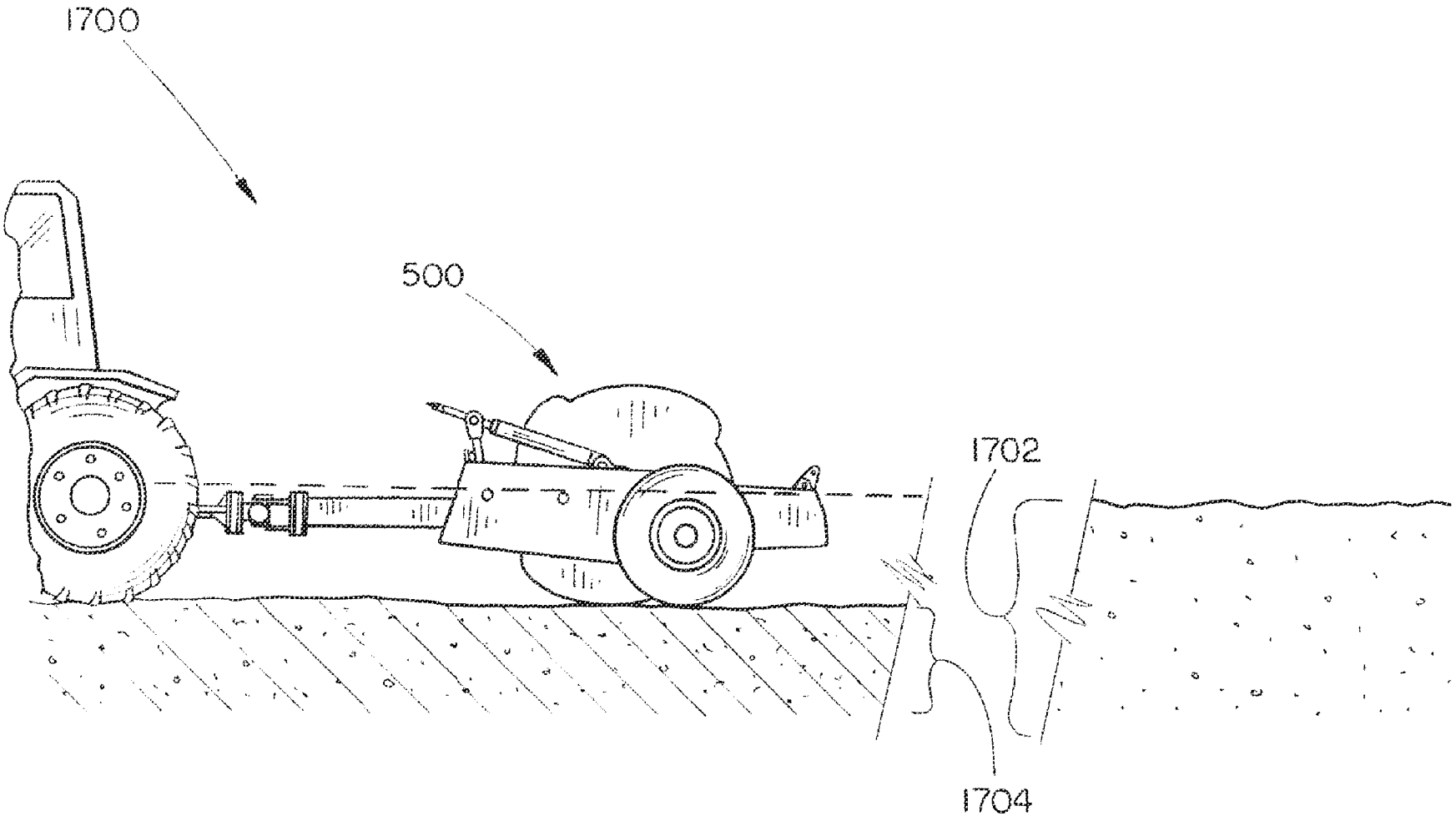
FIG. 17 is a side view illustrating a surface before and after an apparatus according to an exemplary embodiment of the present invention has compacted the surface.
Figure 18:
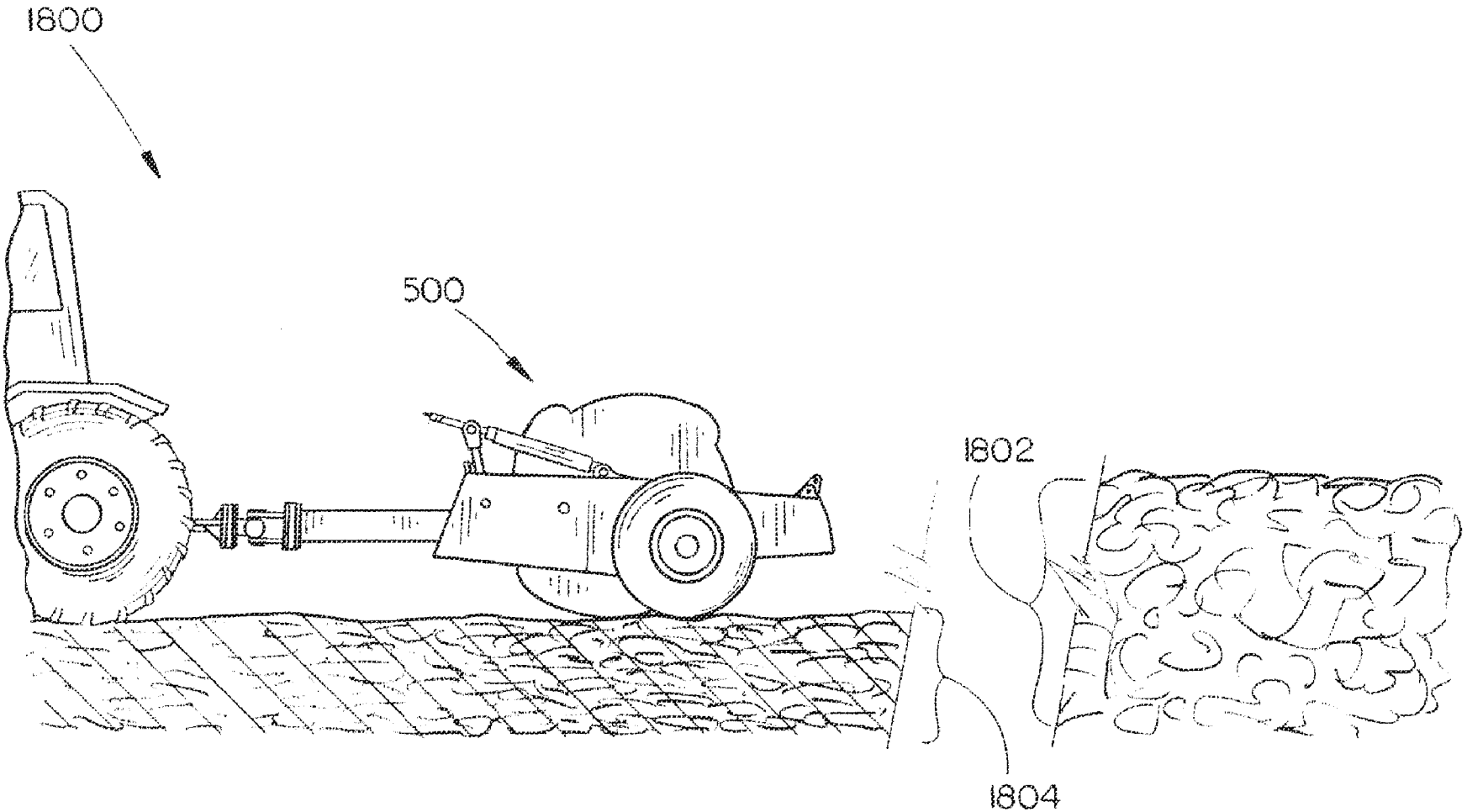
FIG. 18 is a side view illustrating a landfill before and after an apparatus according to an exemplary embodiment of the present invention has compacted the landfill.

Apparatus may be utilized in a variety of settings and applications. Referring to FIG. 17, a side view illustrating a surface 1700 before and after an apparatus 500 according to an exemplary embodiment of the present invention has compacted the surface. Soil may be at a first depth 1702 prior to compaction and at a second lower depth 1704 after compaction, providing a high density surface. Surfaces, such as soil, sand, gravel, small rock beds and the like may be compacted to remove moisture and provide exemplary foundation preparation. Apparatus may also be utilized in for compacting landfill wastes. Referring to FIG. 18, a side view illustrating a landfill 1800 before 1802 and after 1804 an apparatus 500 according to an exemplary embodiment of the present invention has compacted the landfill is shown. Landfill waste compaction may extend the life of a landfill several years, resulting in significant cost savings and reduction in additional land required to be allocated to landfills.

Figure 19:
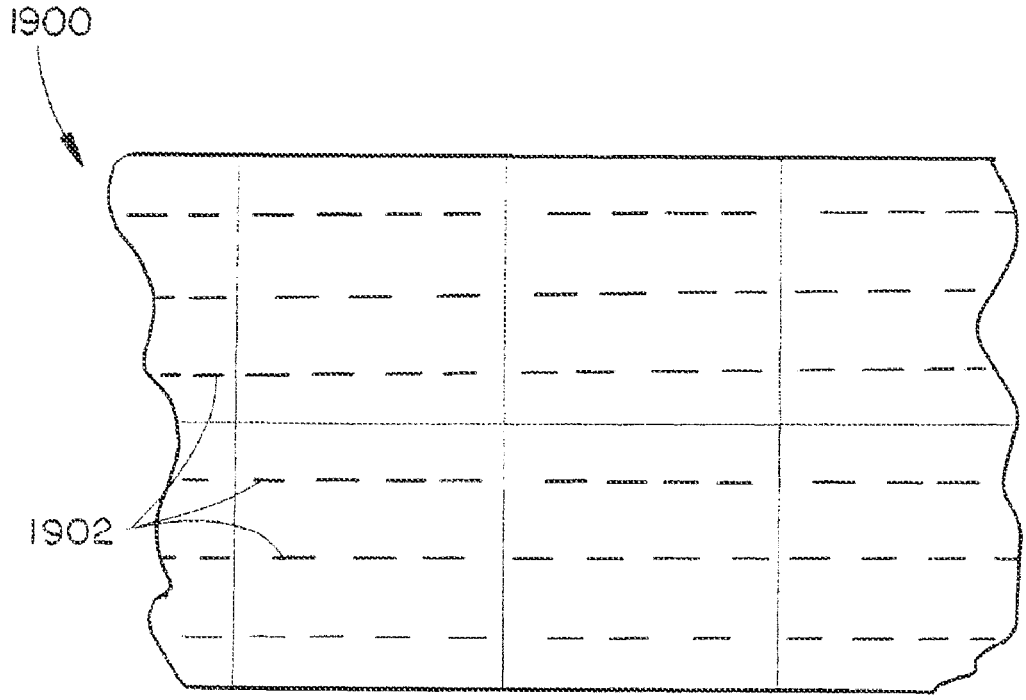
FIG. 19 (PRIOR ART)
FIG. 19 is a top view of a concrete surface after the surface has been broken apart with a prior art guillotine-type concrete breaking apparatus.

Apparatus may be suitable for crack and seat applications for roadways and other surfaces. A typical concrete roadway is laid in blocks, typically 12' by 12' concrete blocks. Changes in weather, concrete settling, impact from motor vehicles and the like often cause shifting in the concrete blocks, creating an undesirable uneven road surface. One method for reducing this shifting is to crack or break up the concrete blocks to allow them to settle and reduce the motion an individual piece of the concrete block. Referring to FIG. 19, a top view of a concrete surface 1900 after the surface has been broken apart with a prior art guillotine-type concrete breaking apparatus.

Figure 20:
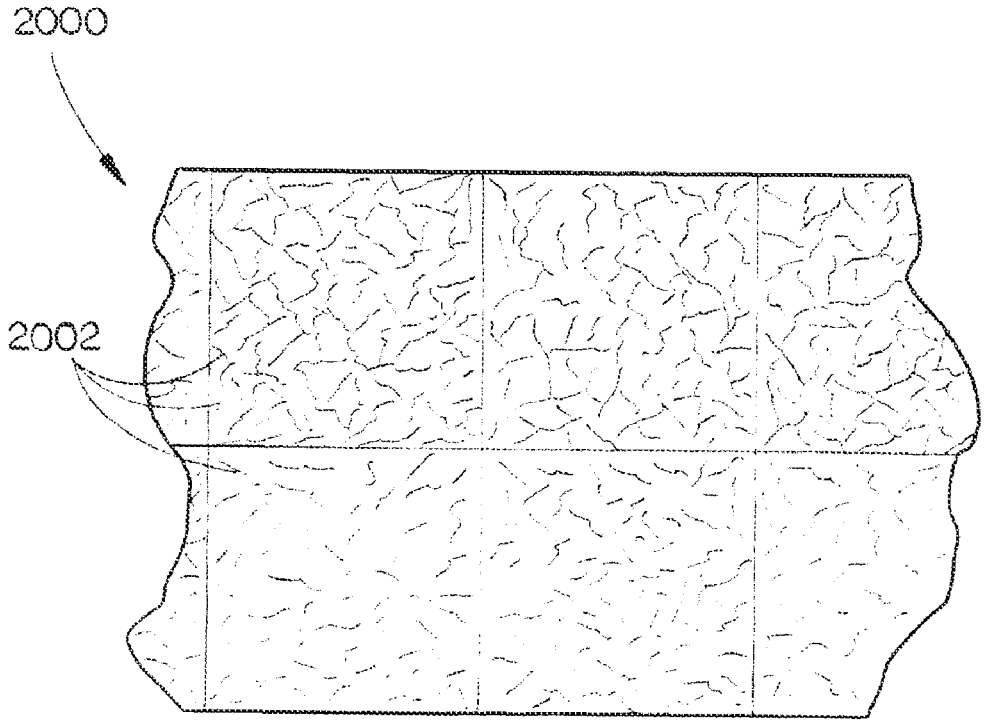
FIG. 20 is a top view of a concrete surface after the surface has been broken apart with a material compaction, breaking and rubblizing apparatus according to an exemplary embodiment of the present invention.

Such guillotine-type devices are utilized to make hash mark-like indentations 1902 in the concrete. Such methods are inefficient and often ineffective to provide the requisite cracking and seating needed to prevent shifting and tilting of the concrete blocks. Further, these methods often cause undesired micro-shifts within the blocks and do not compact the concrete blocks. In contrast, apparatus may be utilized to provide effective, uniform cracking and seating of concrete to substantially reduce or prevent shifting and damage due to changing weather conditions. Referring to FIG. 20, a top view of a concrete surface 2000 after the surface has been broken apart with a material compaction, breaking and rubblizing apparatus according to an exemplary embodiment of the present invention is shown. To this end, roller assembly 100 may pass over one or more concrete blocks at least once and cause web-like cracking 2002 to form within the concrete. Roller assembly 100 may provide sufficient impact to crack substantially through the depth of the concrete block, providing effective breaking up of the block to reduce or eliminate shifting of any of the individual pieces formed from the compaction. A projecting cleat of a first lobe may provide sufficient downward force to prevent a portion of concrete to be impacted by a following lobe from buckling or rising up around the impact point. In this manner, a lobes projecting cleat may serve as a stabilizing hinge point for a subsequent lobe projecting cleat until after the subsequent lobe projecting cleat has impacted the material's surface. Further roller assembly 100 may substantially compress the concrete block and provide a compacted road surface to further prevent moisture seepage and shifting.

Apparatus 500 may be equipped with Ground Penetrating Radar (GPR). Ground-GPR is a technique suitable for measuring asphalt density in real time during the rolling operation. Ground-penetrating radar may also be utilized to determine the thickness and moisture content of asphalt pavement. A GPR device implemented with an embodiment of an apparatus 500 of the present invention may be also be suitable for determining asphalt pavement density during the compaction process in real time. For instance GPR device may comprise a computer program capable of determining the density and water (or other fluid) content of the various layers within a multilayer system, and using conventional GPR to obtain digitized images of a reflected radar signal from a multilayer pavement system. It is further contemplated that the GPR system may utilize micropower impulse radar (MIR) technology for certain measurements. In another alternative embodiment, the system could be implemented with a GPS, A-GPS or other position determining devices to correlate locations on the surface with measurements at those locations.

Figure 21:
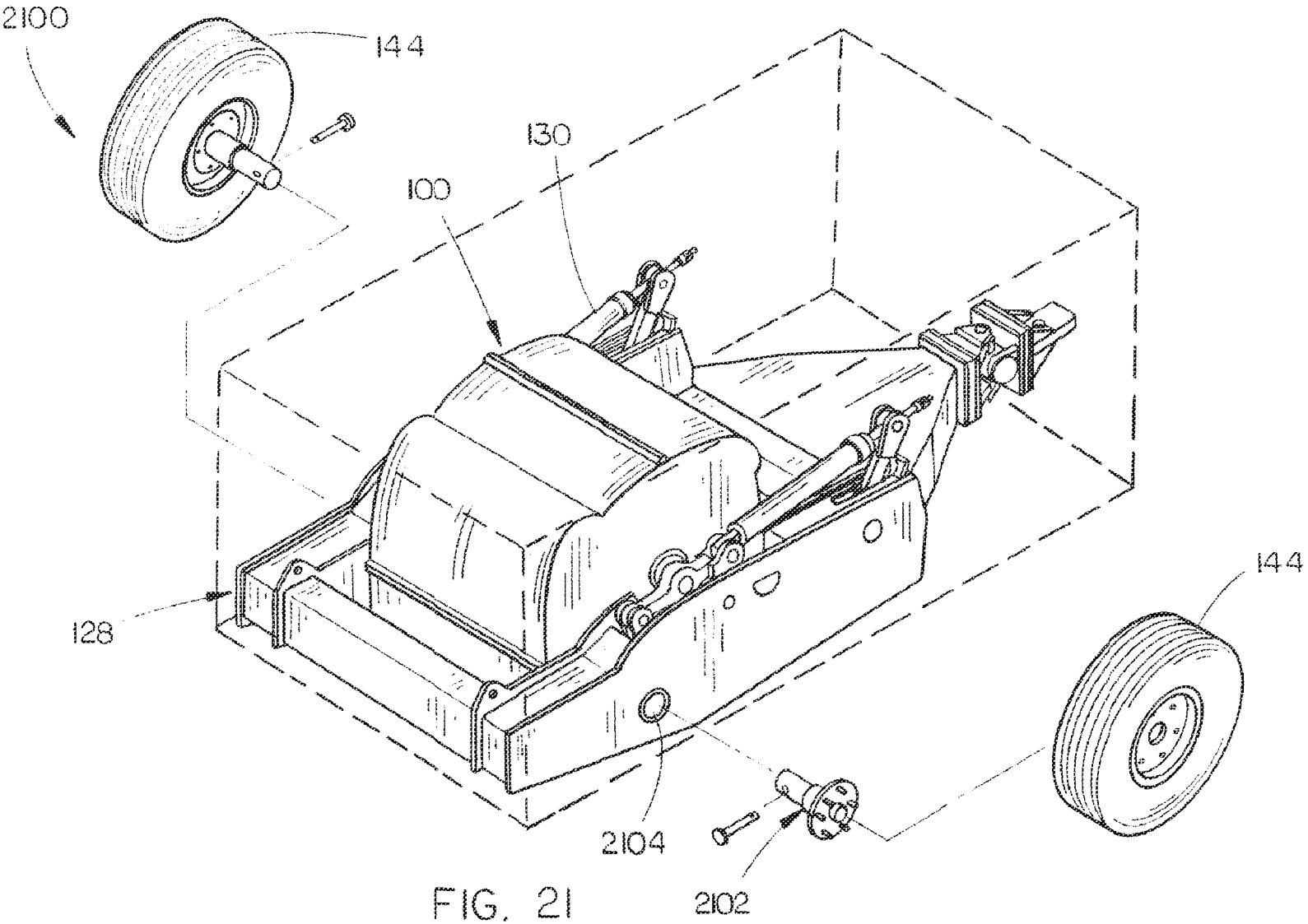
FIG. 21 is an isometric illustration of a material compaction, breaking and rubblizing apparatus according to an exemplary embodiment of the present invention in a shipping container.

Referring to FIG. 21, an isometric view 2100 of an apparatus 500 for material compaction, breaking and rubblizing according to an exemplary embodiment of the present invention in a shipping container is shown. Apparatus 500 may be suitable for shipping in a substantially upright position by utilizing a shipping container attachment assembly 2102 suitable for securing the apparatus 500 within a containing assembly 2104. Frame assembly 128 may be configured with at least two apertures 2104 through which the shipping container attachment assembly 2102 may be inserted.

Figure 22:
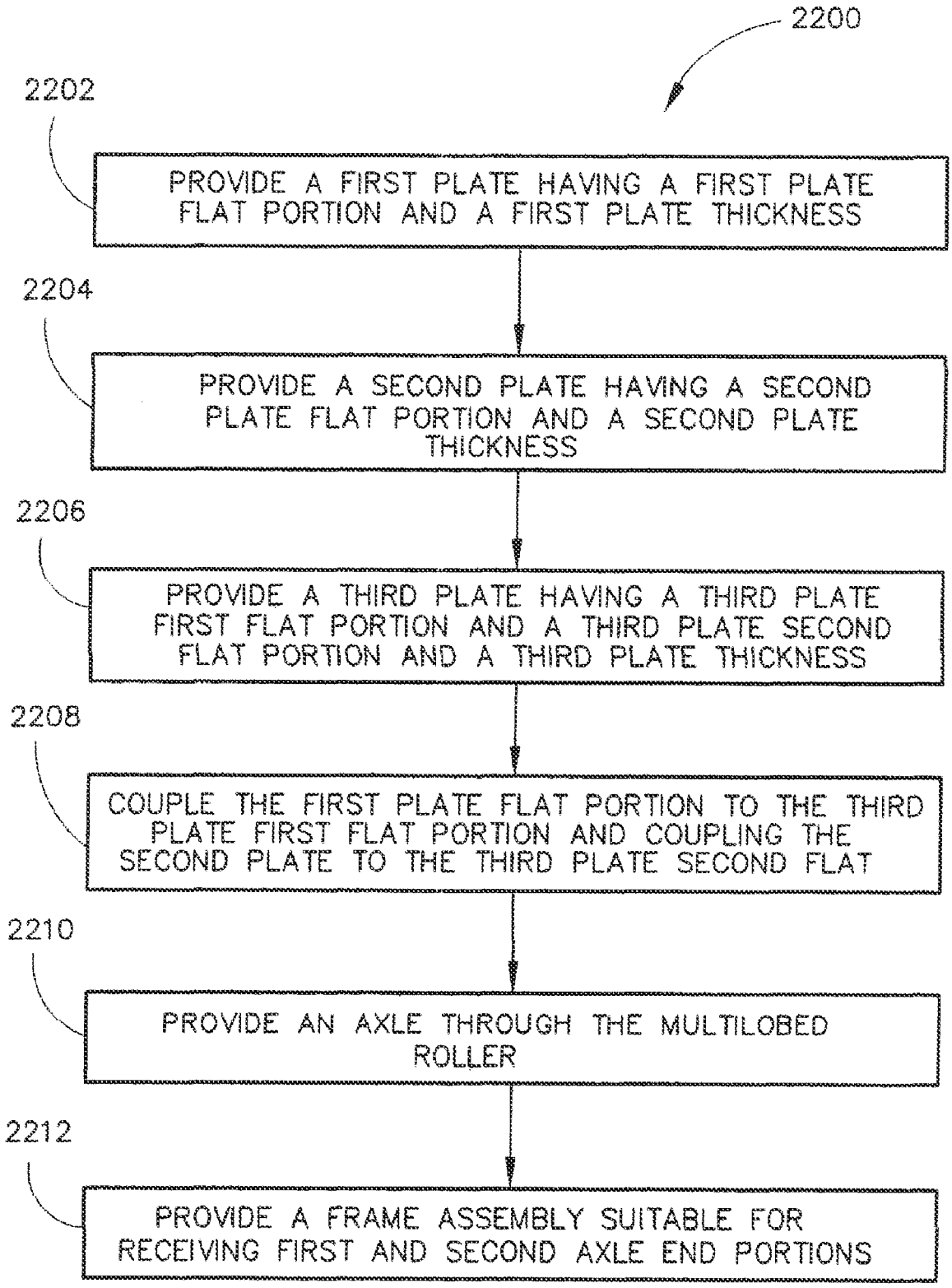
FIG. 22 is a flow diagram depicting a method for manufacturing a material compaction, breaking and rubblizing apparatus according to an exemplary embodiment of the present invention.

Referring to FIG. 22, a flowchart depicting a method 2200 for manufacturing a roller apparatus is shown. Method 2200 comprises providing a first plate having a first plate flat portion and a first plate thickness 2202. Method 2200 also comprises providing a second plate having a second plate flat portion and a second plate thickness 2204 substantially equivalent to the first plate thickness, and providing a third plate having a third plate first flat portion and a third plate second flat portion and a third plate thickness less than the first plate thickness and the second plate thickness 2206. First plate and second plate may be non-circular. Method 2200 comprises coupling the first plate flat portion to the third plate first flat portion and coupling the second plate to the third plate second flat portion 2208. Method 2200 may also comprise configuring each of the first plate and the second plate to form a non-circular multi-lobed roller when coupled to the third plate. Each of the first plate, the second plate and the third plate may each comprise a centrally located aperture. Method 2200 may comprise providing an axle through the multi lobed roller 2210. In an additional embodiment, only an outer surface of the first plate and the second plate comprise apertures suitable for receiving an axle assembly. The multi-lobed roller is suitable for rotatably mounting on an axle. Method 2200 may comprise providing a frame assembly suitable for receiving first and second axle end portions 2212 to mount the axle onto the frame assembly. Multi-lobed roller may follow the frame as the frame moves along the ground. Method 2200 further comprises providing a plurality of first non-continuous raised impact surfaces substantially across the width of each lobe of the multi-lobed roller. The first non-continuous raised impact surfaces have a first raised impact surface thickness. Method 2200 also comprises providing at least one second continuous raised impact surface on each lobe of the multi-lobed roller. The second continuous raised impact surface has a second raised impact surface thickness less than the first raised impact surface thickness and continuously extends substantially across the width of a lobe of the multi-lobed roller. Each of the first raised impact surfaces and the second raised impact surface are suitable for contacting the ground as the multi-lobed roller rotates on the axle. The first raised impact surfaces are positioned on a lobe contact the ground first, providing primary breaking and compacting of the surface. The second raised impact surface is positioned on the lobe to contact the ground subsequent to the first raised impact surface, providing secondary breaking and compacting of the surface.

Figure 23:
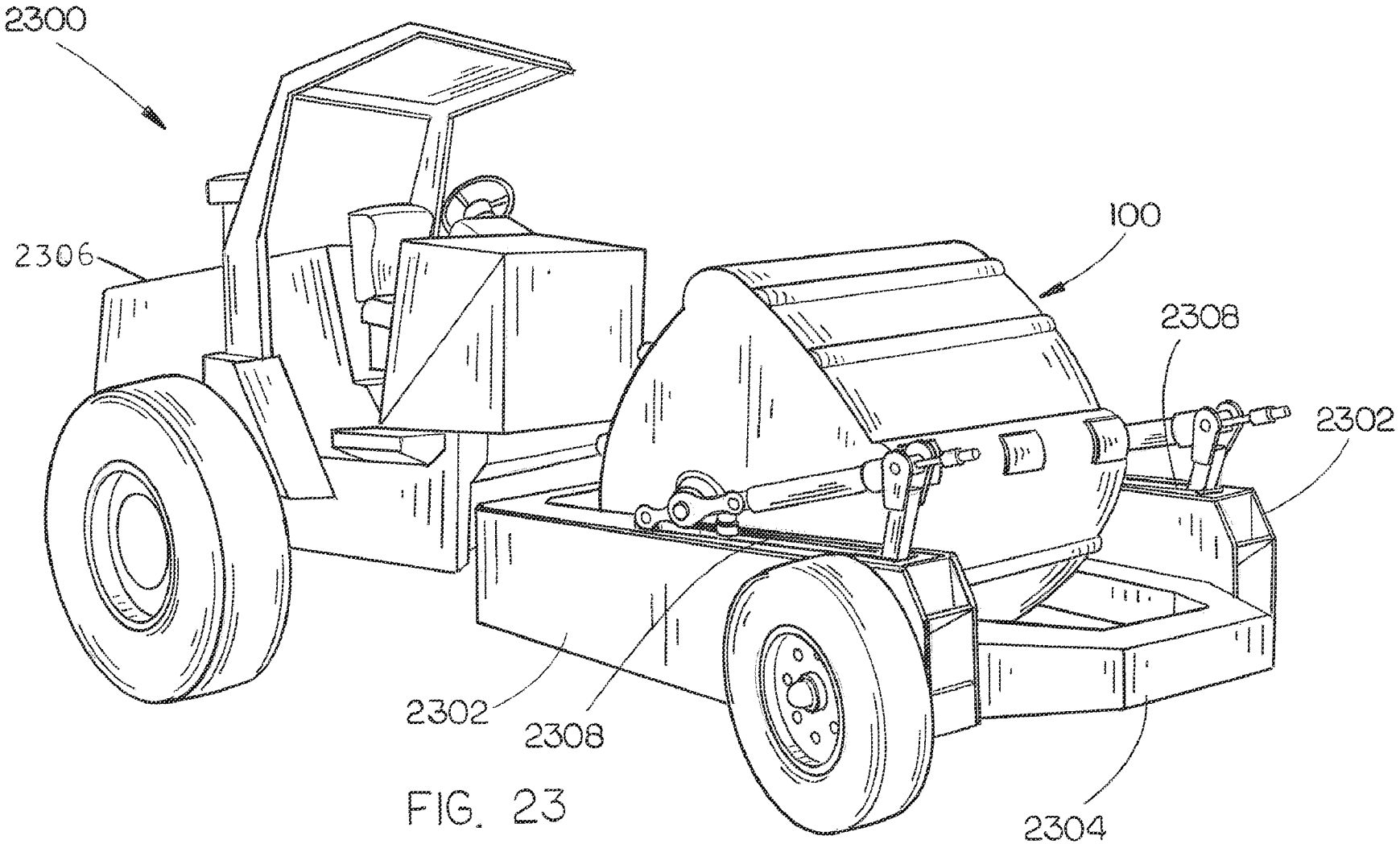
FIG. 23 is an isometric illustration of a roller assembly attached to a roller carriage according to an exemplary embodiment of the present invention.

FIG. 23 is an isometric illustration 2300 of a roller assembly attached to a roller carriage according to an exemplary embodiment of the present invention. In this embodiment, roller assembly 100 may be attached to a push type roller assembly carriage capable of pushing the roller assembly 100. A roller carriage may be movably mounted on a conventional tractor or other machine capable of pushing the roller assembly. The machine may be connected the frame assembly via a front portion of the machine. The roller assembly 100 may be coupled to roller carriage side supports 2302 by any connection means. The tractor or other machine 2306 may drive the carriage in a usual, well known manner. The side supports 2302 may be elevated above a surface and may provide an opening into which a roller assembly may be mounted. The side supports 2302 may include receiving portions 2308 for receiving spring assembly 130, axle assembly 120, and/or linkage assembly 162. Alternatively, the side supports 2302 may include mounting means for mounting the roller assembly 100, spring assembly 130, axle assembly 120, and/or linkage assembly 162 within an opening of the frame 2302. The carriage may also include a front plate portion 2304 (e.g., a flat rectangularly shaped plate) fixedly connected to front portions of the side supports 2302.

In further embodiments, roller assembly 100 may be formed from poured steel or concrete. Steel or concrete may be poured into a pre-fabricated mold formed to produce the shape of the roller assembly 100 and the roller assembly components described above.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof.

The invention claimed is:

1. A system for compaction, breaking and rubblizing comprising:

a roller assembly including:

a first non-circular plate having a first plate flat portion and a first plate diameter;

a second non-circular plate having a second plate flat portion and a second plate diameter substantially equivalent to said first plate diameter; and a third plate having a third plate first flat portion coupled to the first plate flat portion and a third plate second flat portion coupled to the second plate flat portion forming a non-circular multi-lobed roller assembly including a plurality of lobes, the third plate having a third plate diameter less than the first plate diameter and the second plate diameter;

a weld material substantially covering an outer edge of the third plate not in contact with the first non-circular plate or the second non-circular plate, the weld material having a thickness substantially equivalent to a difference between at least one of the first plate diameter and the third plate diameter, or the second plate diameter and the third plate diameter;

a first axle assembly coupled to an exterior lateral portion of the first non-circular plate;

a second axle assembly coupled to an exterior lateral portion of the second non-circular plate;

a frame assembly suitable for receiving the first axle assembly and the second axle assembly; and a machine connected the frame assembly via a front portion of the machine, the machine suitable for pushing the frame assembly, wherein the multi-lobed roller assembly is rotatably mounted to the frame assembly and rotates about the first axle assembly and the second axle assembly, and following the frame assembly as the frame assembly moves along a surface of a material.

2. The system of claim 1, wherein the frame assembly comprises a spring assembly suitable for providing adequate force needed to initiate and maintain a rolling motion of the non-circular multi-lobed roller assembly.

3. The system of claim 2, wherein the spring assembly includes a plurality of concentric springs, further including at least a first spring suitable for insertion through a second spring, and a second spring suitable for insertion through a third spring.

4. The system of claim 2, wherein the spring assembly further includes a damping assembly.

5. The system of claim 1, further including a grading assembly coupled to a rear portion of the frame assembly.

6. The system of claim 1, wherein the frame assembly includes a plurality of wear pads suitable for reducing wear at least one of the first axle assembly or the second axle assembly.

7. The system of claim 1, further including a shock absorption assembly suitable for absorbing shock as the non-circular multi-lobed roller assembly is turning.

8. The system of claim 1, further including at least one additional non-circular multi-lobed roller assembly mounted to the frame assembly in tandem with the non-circular multi-lobed roller assembly.

9. The system of claim 1, further including a ground penetrating radar device for measuring asphalt density in real time during the rolling operation.

10. The system of claim 1, wherein the frame assembly includes at least two apertures through which a shipping container attachment assembly may be inserted.

11. The system of claim 1, further including at least two side supports.

12. The system of claim 11, wherein the at least two side supports include receiving portions for receiving a spring assembly, an axle assembly or a linkage assembly.

13. The system of claim 11, further including a front plate portion fixedly connected to front portions of the side supports.

14. The system of claim 11, further including a machine suitable for pushing the roller assembly.

* * * * *